US012076610B2

(12) United States Patent
Bosch

(10) Patent No.: US 12,076,610 B2
(45) Date of Patent: Sep. 3, 2024

(54) EXERCISE APPARATUS

(71) Applicant: Greg Bosch, St. George, SC (US)

(72) Inventor: Greg Bosch, St. George, SC (US)

(73) Assignee: Greg Bosch, St. George, SC (US)

( * ) Notice: Subject to any disclaimer, the term of this patent is extended or adjusted under 35 U.S.C. 154(b) by 110 days.

(21) Appl. No.: 17/510,353

(22) Filed: Oct. 25, 2021

(65) Prior Publication Data

US 2022/0152448 A1 May 19, 2022

Related U.S. Application Data

(63) Continuation-in-part of application No. 16/992,778, filed on Aug. 13, 2020, now Pat. No. 11,154,751.

(Continued)

(51) Int. Cl.
*A63B 21/00* (2006.01)
*A63B 21/04* (2006.01)

(Continued)

(52) U.S. Cl.
CPC ..... *A63B 21/4034* (2015.10); *A63B 21/0435* (2013.01); *A63B 21/0552* (2013.01);

(Continued)

(58) Field of Classification Search
CPC ..... A63B 21/00058; A63B 21/00061; A63B 21/00065; A63B 21/00178; A63B 21/00181; A63B 21/00185; A63B 21/002; A63B 21/0023; A63B 21/02; A63B 21/04; A63B 21/0407; A63B 21/0414; A63B 21/0421; A63B 21/0428; A63B 21/0435; A63B 21/0442; A63B 21/055; A63B 21/0552; A63B 21/0555; A63B 21/0557; A63B 21/15; A63B 21/151; A63B 21/154;

(Continued)

(56) References Cited

U.S. PATENT DOCUMENTS 2,256,001 A * 9/1941 Titus ..... A63B 22/14 601/32
2,351,293 A * 6/1944 Saunders ..... A63B 22/14 280/87.041

(Continued)

FOREIGN PATENT DOCUMENTS

CN 110917566 A * 3/2020 ..... A63B 21/045
KR 2020007507 A * 1/2020 ..... A63B 21/0407
KR 491510 Y1 * 4/2020 ..... A63B 22/14

*Primary Examiner* — Gary D Urbiel Goldner

(74) *Attorney, Agent, or Firm* — Tarter Krinsky & Drogin LLP

(57) ABSTRACT

Exemplary embodiments of a portable exercise apparatus are provided, the exercise apparatus including a base, a bottom plate secured to a top portion of the base, a bracket affixed to the bottom plate, a base plate secured to a top portion of the bottom plate, the base plate including a plurality of holes on a top surface of the base plate, a foot plate secured to a top portion of the base plate and configured to selectively engage with at least one of the plurality of holes on the top surface of the base plate, such that when the foot plate is rotated the base plate and bottom plate also rotate, a threaded hole on the base, and a first resistance element having a first end secured to the threaded hole on the base and a second end secured to the bottom plate.

20 Claims, 29 Drawing Sheets

Related U.S. Application Data

(60) Provisional application No. 62/979,090, filed on Feb. 20, 2020.

(51) Int. Cl.

| | |
|---|---|
| ***A63B 21/055*** | (2006.01) |
| ***A63B 23/035*** | (2006.01) |
| ***A63B 23/08*** | (2006.01) |
| ***A63B 71/06*** | (2006.01) |

(52) U.S. Cl.

CPC ..... *A63B 21/154* (2013.01); *A63B 21/4049* (2015.10); *A63B 23/03516* (2013.01); *A63B 23/085* (2013.01); *A63B 2071/0694* (2013.01); *A63B 2225/09* (2013.01)

(58) Field of Classification Search

CPC . A63B 21/22; A63B 21/4027; A63B 21/4033; A63B 21/4034; A63B 21/4039; A63B 21/4049; A63B 22/0046; A63B 22/14; A63B 22/18; A63B 2022/185; A63B 2023/003; A63B 23/0216; A63B 23/0222; A63B 23/035; A63B 23/03508; A63B 23/03516; A63B 23/03533; A63B 23/03541; A63B 23/04; A63B 23/0405; A63B 23/0482; A63B 23/08; A63B 23/085; A63B 69/0057; A63B 69/0062; A63B 71/0054; A63B 2071/0063; A63B 2071/0072; A63B 2071/0694; A63B 2208/0204; A63B 2208/0228; A63B 2208/0233; A63B 2225/09

See application file for complete search history.

(56) References Cited

U.S. PATENT DOCUMENTS

| | | | | | |
|---|---|---|---|---|---|
| 3,911,907 | A * | 10/1975 | Smith, Jr. | A63B 23/03533 | 601/5 |
| 4,390,180 | A * | 6/1983 | Simjian | A63B 22/14 | 482/146 |
| 4,515,363 | A * | 5/1985 | Schleffendorf | A63B 23/03533 | 482/136 |
| 5,102,121 | A * | 4/1992 | Solow | A63B 21/0628 | 482/137 |
| 5,256,127 | A * | 10/1993 | Yeh | A63B 22/14 | 482/146 |
| 5,368,535 | A * | 11/1994 | Twardokens | A63B 23/04 | 482/79 |
| 5,632,711 | A * | 5/1997 | Hwang | A63B 23/03575 | 482/146 |
| 5,722,921 | A * | 3/1998 | Simonson | A63B 21/4033 | 482/137 |
| 5,941,807 | A * | 8/1999 | Cassidy | A63B 21/4009 | 482/130 |
| 6,283,897 | B1 * | 9/2001 | Patton | A63B 21/055 | 482/79 |
| 6,749,529 | B1 * | 6/2004 | Sobolewski | A63B 22/14 | 473/451 |
| 7,081,074 | B1 * | 7/2006 | Rubin | A63B 22/14 | 482/146 |
| 7,278,956 | B1 * | 10/2007 | Chen | A63B 22/0605 | 482/57 |
| 7,396,319 | B1 * | 7/2008 | Ellis | A63B 23/0488 | 482/136 |
| 7,591,774 | B1 * | 9/2009 | Tien | A63B 22/14 | 482/146 |
| 7,604,576 | B2 * | 10/2009 | Drechsler | A63B 21/4017 | 482/99 |
| 7,621,861 | B1 * | 11/2009 | Kalember | A63B 22/14 | 482/79 |
| 7,909,747 | B1 * | 3/2011 | LaCaze | A63B 21/00069 | 482/142 |
| 9,295,873 | B1 * | 3/2016 | LaCaze | A63B 21/4035 | |
| 9,393,458 | B1 * | 7/2016 | LaCaze | A63B 22/14 | |
| 9,446,288 | B1 * | 9/2016 | Pazan | A61H 1/0285 | |
| 10,549,152 | B2 * | 2/2020 | Walker | A63B 21/4049 | |
| 10,737,139 | B2 * | 8/2020 | Walker | A63B 21/4049 | |
| 11,331,536 | B1 * | 5/2022 | Wood | A61B 5/1124 | |
| 2003/0216221 | A1 * | 11/2003 | Iverson | A63B 69/0022 | 482/148 |
| 2009/0163337 | A1 * | 6/2009 | Petrakov | A63B 22/14 | 482/147 |
| 2011/0028870 | A1 * | 2/2011 | Greenburg | A63B 21/40 | 482/129 |
| 2011/0287914 | A1 * | 11/2011 | Morris | A63B 23/0205 | 482/147 |
| 2012/0143101 | A1 * | 6/2012 | Schmidt | A61H 1/0244 | 601/5 |
| 2013/0085048 | A1 * | 4/2013 | Na | A63B 23/0482 | 482/142 |
| 2016/0074702 | A1 * | 3/2016 | MacDonald | A63B 21/225 | 482/147 |
| 2016/0236025 | A1 * | 8/2016 | Henan | A63B 23/0355 | |
| 2016/0263424 | A1 * | 9/2016 | LaCaze | A63B 21/068 | |
| 2016/0279459 | A1 * | 9/2016 | Walker | A63B 21/4047 | |
| 2017/0340918 | A1 * | 11/2017 | Walker | A63B 21/4049 | |
| 2018/0117384 | A1 * | 5/2018 | Endelman | A63B 21/025 | |
| 2018/0361200 | A1 * | 12/2018 | Walker | A63B 21/00069 | |
| 2019/0290967 | A1 * | 9/2019 | Huber | A63B 22/14 | |
| 2020/0338419 | A1 * | 10/2020 | Di Prima | A63B 69/00 | |
| 2020/0338420 | A1 * | 10/2020 | Di Prima | A63B 69/00 | |
| 2021/0260438 | A1 * | 8/2021 | Bosch | A63B 21/154 | |
| 2022/0062695 | A1 * | 3/2022 | Yeo | A63B 23/08 | |

* cited by examiner

EXCERCISE 3

EXCERCISE 4

EXCERCISE 5

(A) (B) (C)

EXCERCISE 6

(A) (B) (C)

EXERCISE APPARATUS

CROSS-REFERENCE TO RELATED APPLICATIONS

This application is a continuation-in-part of and claims priority from U.S. patent application Ser. No. 16/992,778 filed on Aug. 13, 2020, which relates to and claims priority from U.S. Provisional Patent Application Ser. No. 62/979,090 filed Feb. 20, 2020, the entire disclosure of which is hereby incorporated herein by reference.

FIELD OF THE DISCLOSURE

The present disclosure relates to exemplary embodiments of an exercise apparatus, and more particularly, to exemplary embodiments of an exercise apparatus used for training and rehabilitation exercises.

BACKGROUND INFORMATION

Various exercise apparatuses are provided for weight and strength training. The exemplary embodiments of the present disclosure can provide for an exercise apparatus that can be used by a user or trainer for isokinetic evaluation, testing, training and rehabilitation.

SUMMARY OF EXEMPLARY EMBODIMENTS OF THE DISCLOSURE

Exemplary embodiments of the present disclosure can provide for an exercise apparatus comprising a base, a bottom plate secured to a top portion of the base, a bracket affixed to the bottom plate, a base plate secured to a top portion of the bottom plate, the base plate including a plurality of holes on a top surface of the base plate, a foot plate secured to a top portion of the base plate and configured to selectively engage with at least one of the plurality of holes on the top surface of the base plate, such that when the foot plate is rotated the base plate and bottom plate also rotate, a threaded hole on the base, and a first resistance element having a first end secured to the threaded hole on the base and a second end secured to the bottom plate, such that resistance is provided from the first resistance element when the bottom plate, base plate and foot plate are rotated with respect to the base.

In some exemplary embodiments, the first resistance element comprises a first resistance tube, a first hollow end portion secured to a first end of the first resistance tube, and a first hook secured to the first resistance tube at a second end of the first resistance tube opposite the first end. The exercise apparatus can further comprise a threaded bolt configured to be inserted within the first hollow end portion of the first resistance element and the threaded hole of the base to secure the first resistance element to the base. The exercise apparatus can further comprise a bracket secured to the bottom plate, the bracket having one or more holes that the hook of the first resistance element is secured to.

In some exemplary embodiments, the exercise apparatus further comprises a second resistance element having a first end secured to the threaded hole on the base and a second end secured to the bottom plate, such that resistance is provided from the first resistance element and the second resistance element when the bottom plate, base plate and foot plate are rotated with respect to the base. The second resistance element can further comprise a second resistance tube, a second hollow end portion secured to a first end of the second resistance tube, and a second hook secured to the second resistance tube at a second end of the second resistance tube opposite the first end.

In some exemplary embodiments, the threaded bolt is configured to be inserted within the first hollow end portion of the first resistance element and the second hollow end portion of the second resistance element, and the threaded hole of the base to secure the first resistance element and the second resistance element to the base, and the second hook is secured to the one or more holes of the bracket secured to the bottom plate.

In some exemplary embodiments, the exercise apparatus further comprises a tapered pin on a bottom surface of the foot plate that can engage with one of the plurality of holes of the base plate. The tapered pin can be engaged to the one of the plurality of holes of the base plate, the foot plate and base plate are configured to rotate with respect to the base. The tapered pin can be tapered at an angle of approximately three degrees to approximately five degrees. In some exemplary embodiments, the exercise apparatus further comprises a plate angle indicator provided on the base that provides an angle that the foot plate and base plate are rotated with respect to the base.

In some exemplary embodiments, the exercise apparatus further comprises a first support plate provided on the foot plate and having a first wall extending upward from the foot plate, and a second support plate provided on the foot plate and having a second wall extending upward from the foot plate, wherein a user's foot can be placed between the first wall and the second wall. The first support plate and the second support plate can include slots.

In some exemplary embodiments, the exercise apparatus further comprises one or more threaded knobs provided through the slots to secure the first support plate and second support plate to the foot plate. In some exemplary embodiments, the exercise apparatus further comprises padding secured to an inner portion of the first wall and the second wall. The foot plate can be configured to disengage from the base plate when a foot of a user that is placed on the foot plate is lifted such that the user can then rotate the foot plate with respect to the base plate. The plurality of holes on the base plate can comprise eight holes provided equidistant from each other on the top surface of the base plate. The base plate, foot plate and bottom plate can be rotated clockwise or counterclockwise with respect to the base.

In some exemplary embodiments, an exercise apparatus can be provided, comprising a base having a circumferential frame, a plate angle indicator secured within the circumferential frame of the base, a bottom plate secured to a top portion of the base, the bottom plate having a diameter less than a diameter of the plate angular indicator, a bracket affixed to the bottom plate having one or more holes, a base plate secured to a top portion of the bottom plate, the base plate including a plurality of holes on a top surface of the base plate, a foot plate secured to a top portion of the base plate and configured to selectively engage with at least one of the plurality of holes on the top surface of the base plate, such that when the foot plate is rotated the base plate and bottom plate also rotate, a threaded hole on the base, and a resistance element having a first end secured to the threaded hole on the base and a second end secured to one of the one or more holes on the bracket, such that resistance is provided from the resistance element when the foot plate is rotated with respect to the base. The resistance element can comprise resistance tubing and the second end of the resistance element can comprise a hook.

BRIEF DESCRIPTION OF THE DRAWINGS

The foregoing and other objects of the present disclosure will be apparent upon consideration of the following detailed description, taken in conjunction with the accompanying drawings, and claims, in which like reference characters refer to like parts throughout, and in which:

Figure 1:
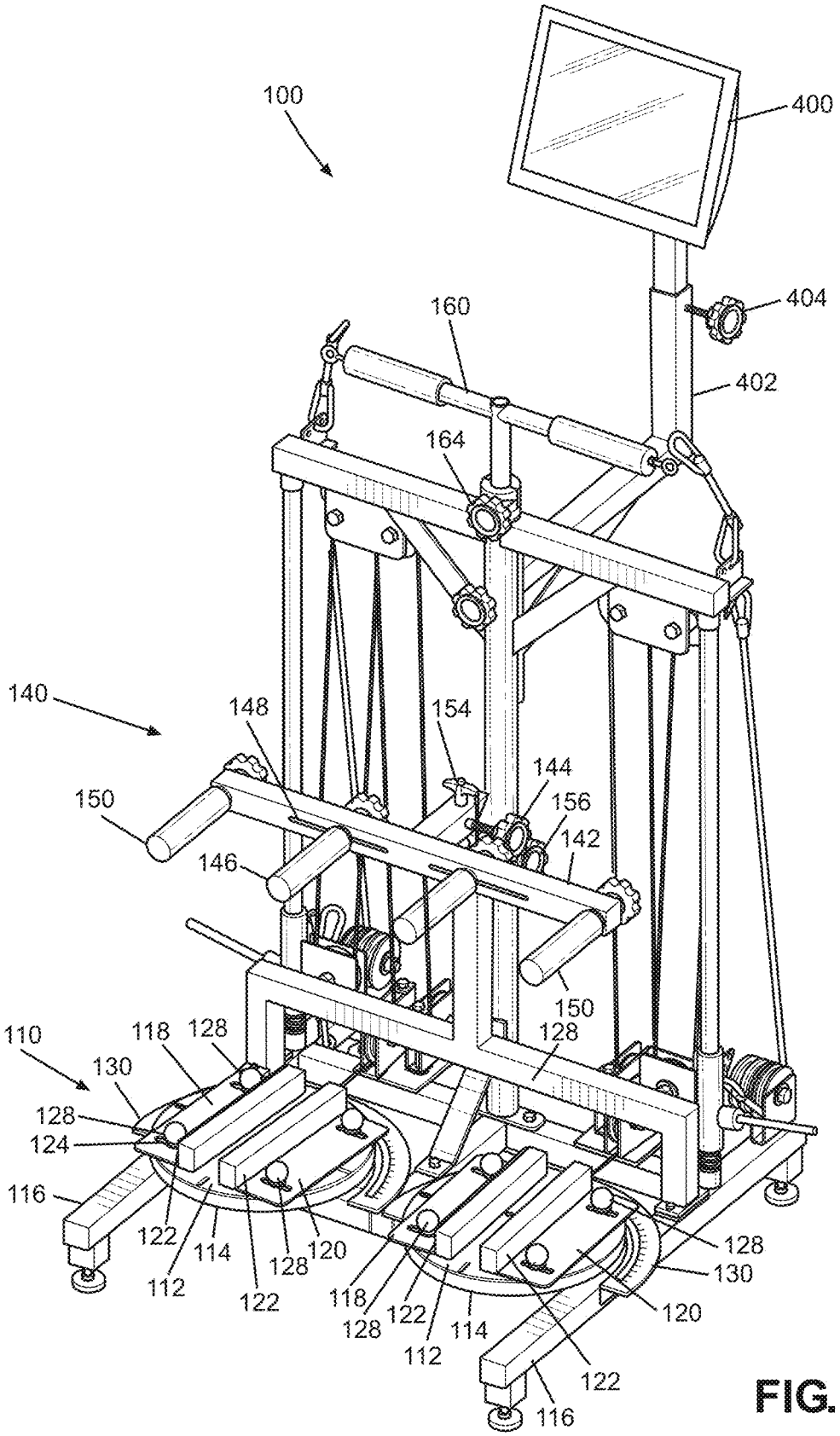
FIG. 1 is a front perspective view of an exercise apparatus according to an exemplary embodiment of the present disclosure.

Throughout the figures, the same reference numerals and characters, unless otherwise stated, are used to denote like features, elements, components or portions of the illustrated embodiments. Moreover, while the subject disclosure will now be described in detail with reference to the figures, it is done so in connection with the illustrative embodiments. It is intended that changes and modifications can be made to the described embodiments without departing from the true scope and spirit of the subject disclosure.

DETAILED DESCRIPTION OF EXEMPLARY EMBODIMENTS OF DISCLOSURE

The exemplary embodiments of the present disclosure can provide for an exercise apparatus that can be used by a user, as well as a therapist or trainer in assisting, testing, evaluating and training the user. The exercise apparatus can be used for sports training for isokinetic evaluation, testing, training and rehabilitation.

Exemplary embodiments of the various methods and apparatuses will now be described with reference to the figures. The following description of the various embodiments is merely exemplary in nature and is in no way intended to limit the scope of the disclosure, its application, or uses.

Figure 2:
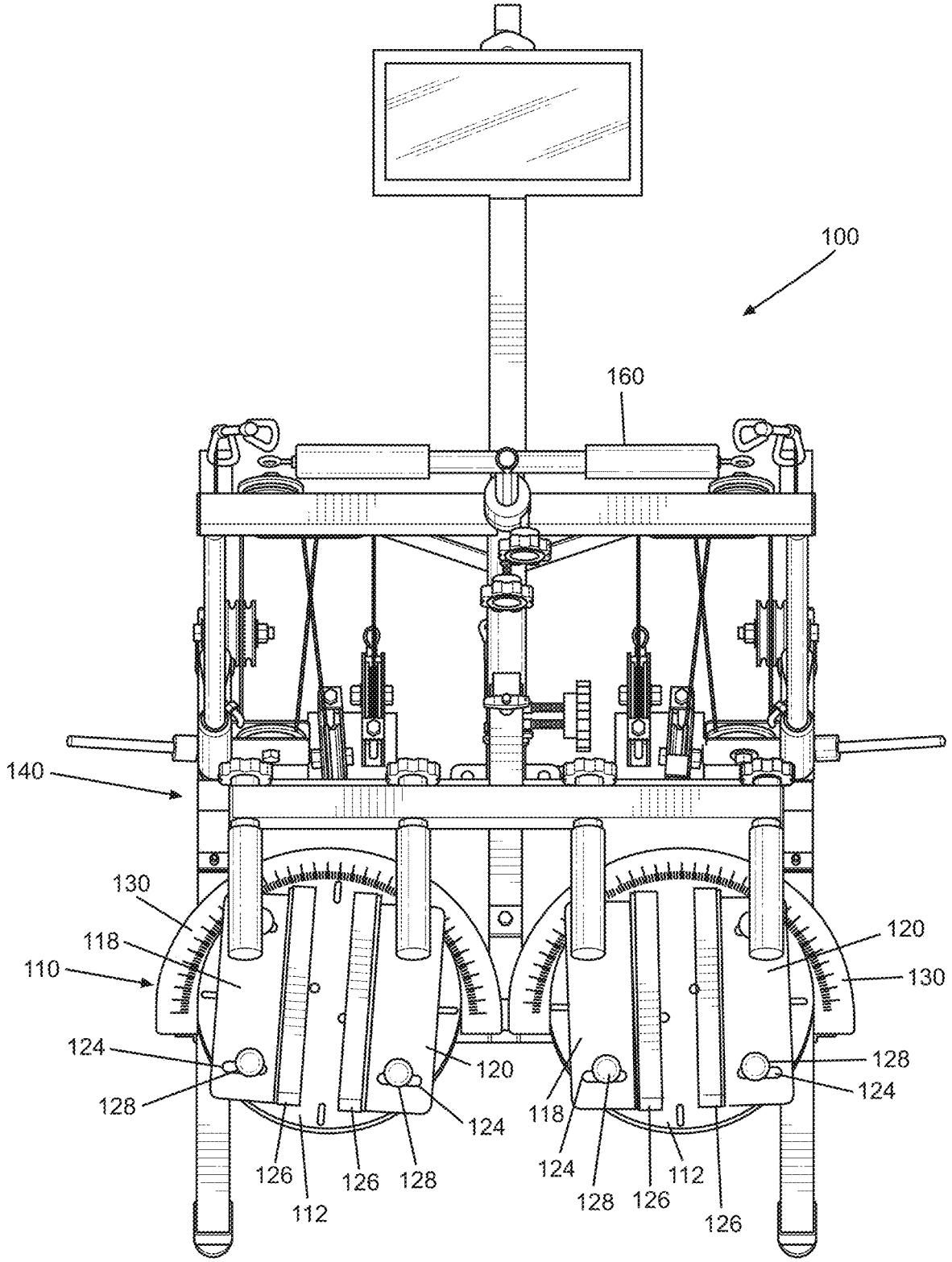
FIG. 2 is a top view of an exercise apparatus according to an exemplary embodiment of the present disclosure.
Figure 3A:
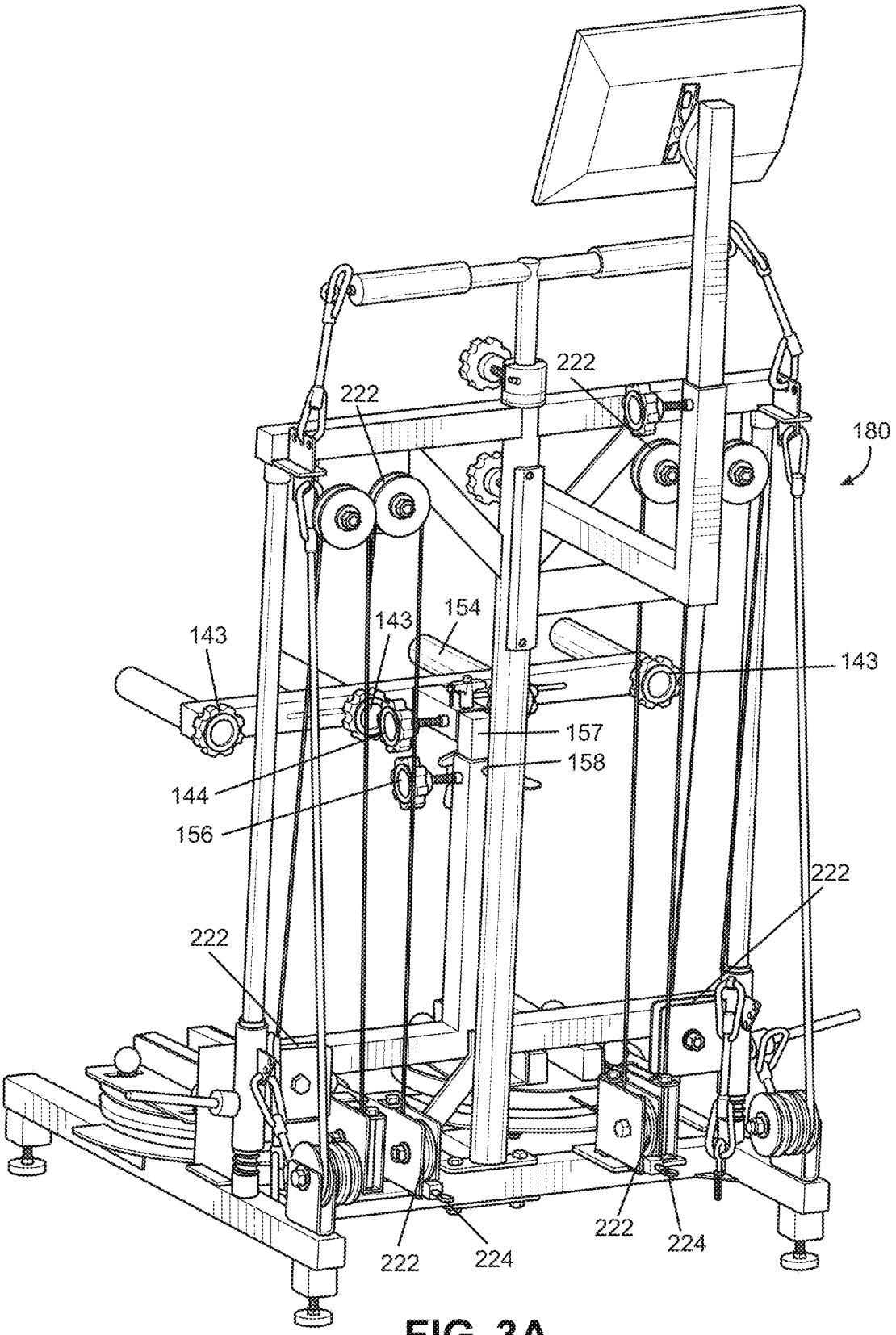
FIG. 3A is a rear perspective view of an exercise apparatus according to an exemplary embodiment of the present disclosure.
Figure 3B:
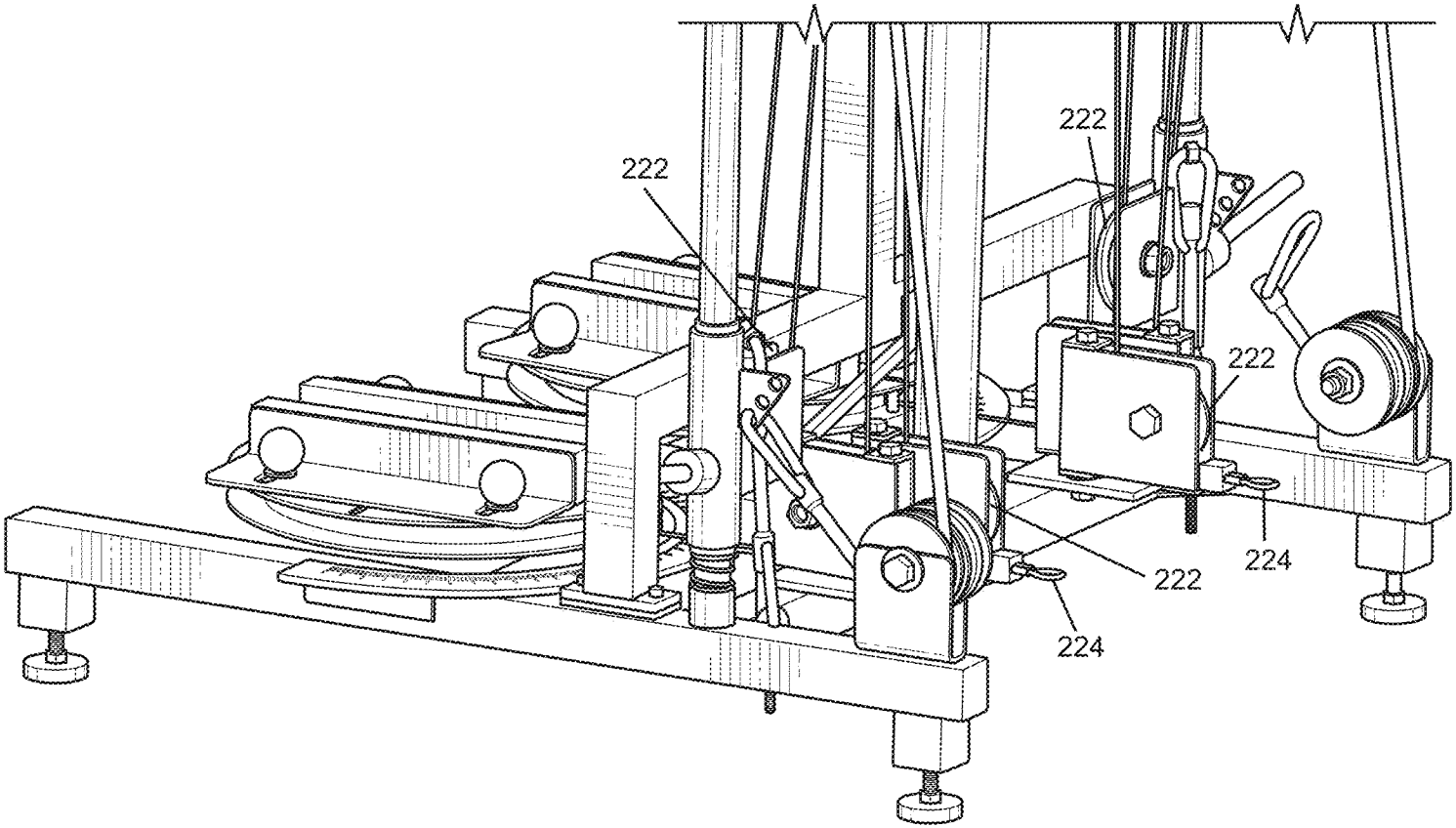
FIG. 3B is a portion of a rear perspective view of an exercise apparatus according to an exemplary embodiment of the present disclosure.

FIGS. 1-3(*b*) are illustrations of an exercise apparatus 100 according to the exemplary embodiments of the present disclosure. The exercise apparatus 100 comprises a foot plate system 110, a knee support 140 and a twist bar 160 at a front portion of the exercise apparatus 100, and a back pulley system 180 at a rear portion of the exercise apparatus 100 (as shown in FIG. 3A).

The foot plate system 110 comprises two foot plates 112, which can be but are not limited to a circular shape. Each foot plate 112 is provided on top of and secured to a base plate 114, such that the foot plate 112 can rotate with respect to the base frame 116, as will be further described below.

A left support plate 118 and a right support plate 120 are provided on top of each foot plate 112. The left support plate 118 and right support plate 120 have a vertically extending wall 122. The left support plate 118 and right support plate 120 can have one or more slots 124 through which threaded knobs 128 secure the left support plate 118 and right support plate 120 to the foot plate 112. The left support plate 118 and right support plate 120 can be but are not limited to a rectangular shape and can protrude at the corners over the foot plates 112. Two vertically extending walls 122 are provided on each of the left support plate 118 and right support plate 120, such that a user's foot can be placed between the vertically extending walls 122 of the left support plate 118 and right support plate 120.

The slots 124 allow the left support plate 118 and right support plate 120 to be adjustable along the base plates 112 to accommodate various widths of users' feet. In some exemplary embodiments, padding 126 such as foam can be provided inward of the vertically extending walls 122 such that a user can place his foot between the padding 126 of the vertically extending walls 122 of the left support plate 118 and the right support plate 120. When a user turns his foot on the foot plate 112, the foot plate 112, left support plate 118, right support plate 120 and base plate 114 all turn in the same direction with respect to the base frame 116.

Figure 5:
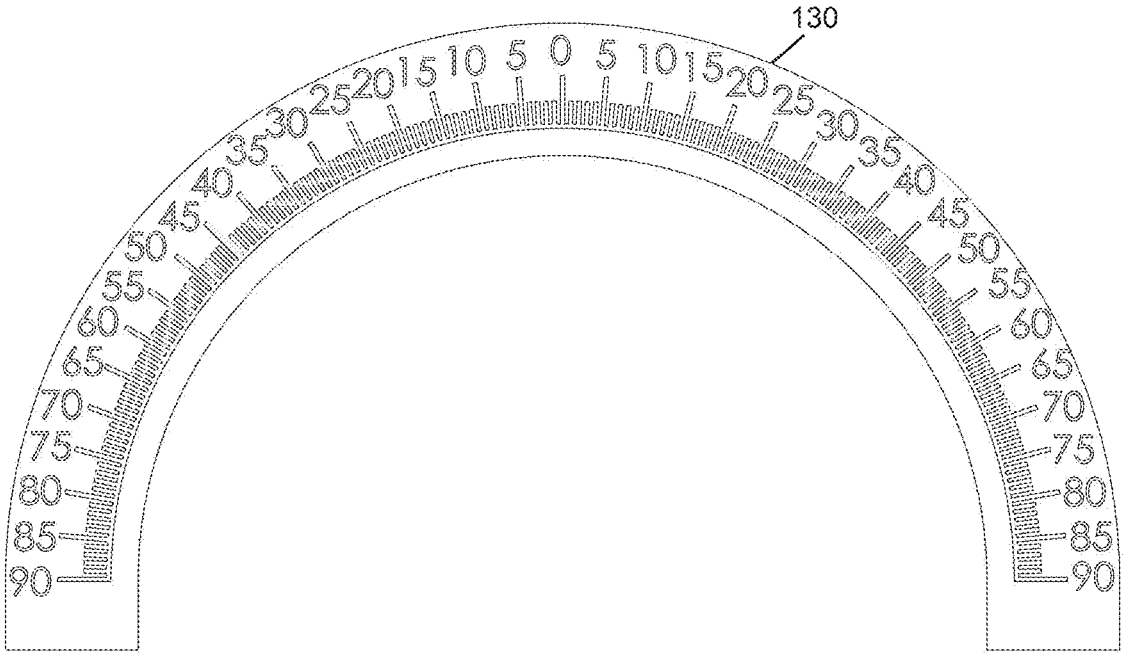
FIG. 5 illustrates a plate angle indicator of the exercise apparatus according to an exemplary embodiment of the present disclosure.

In some exemplary embodiments, a plate angle indicator 130 can be provided on the base frame 116 such that angle measurements are visible at a top portion of each foot plate 112. The plate angle indicator 130 can have but is not limited to a semi-circle shape that extends around a top half circumference of the foot plate 112, as shown in FIGS. 2 and 5. The plate angle indicator can range from 0-90 degrees on both the right and left sides. A top center part of the plate angle indicator 130 can be marked to "0" degrees, and each degree marked accordingly in a clockwise and counterclockwise direction. A needle or indicator line (not shown) can be provided on a top center portion of the foot plate 112 so a user can determine what degree the foot plate 112 is set on with respect to the plate angle indicator 130.

In some exemplary embodiments, the plate angle indicator can be provided surrounding the entire foot plate 112 and base plate 114, showing 360 degrees. The plate angle indicator 130 can allow a user (or therapist and user) to measure a user's range of motion. As the subject moves, the therapist can document at what degree compensations occur such as toes curling downward, a foot that supinates, toes dorsi flexing or fore foot pronation. This process of identifying compensations can help the therapist in the right direction in a rehabilitation process.

A locking mechanism is provided between the foot plate 112 and base plate 114 such that a user can lift the foot plate 112 off of the base plate 114, and turn the foot plate 112 to a desired degree (e.g., 10 degrees) on the plate angle indicator 130. Then, the user can release the foot plate 112, which would then lock the foot plate 112 to the base plate 114 at that location on the base frame 116. In some exemplary embodiments, a strap (not shown) can be provided over the padding 126 and connected between the left support plate 118 and right support plate 120 to allow a user to pick up his foot and lift the foot plate 112 from the base plate 114.

Figure 6A:
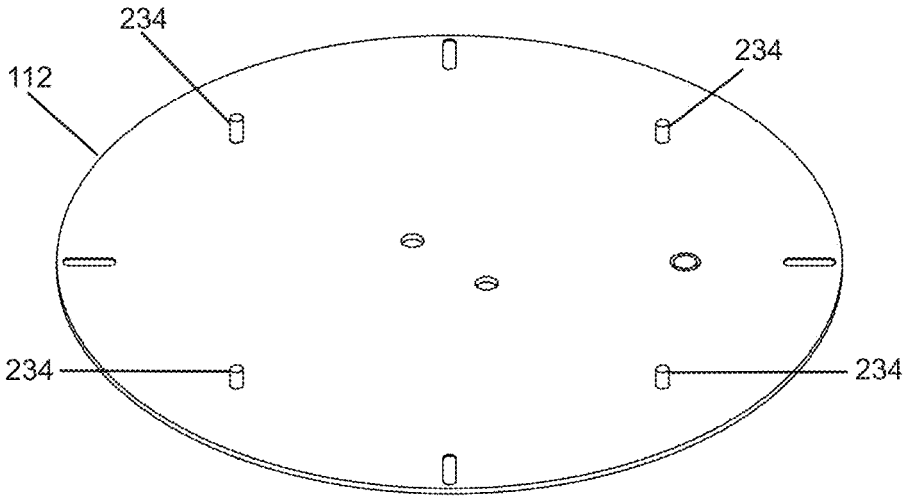
FIG. 6*a* illustrates a top view of a foot plate of the exercise apparatus according to an exemplary embodiment of the present disclosure.
Figure 6B:
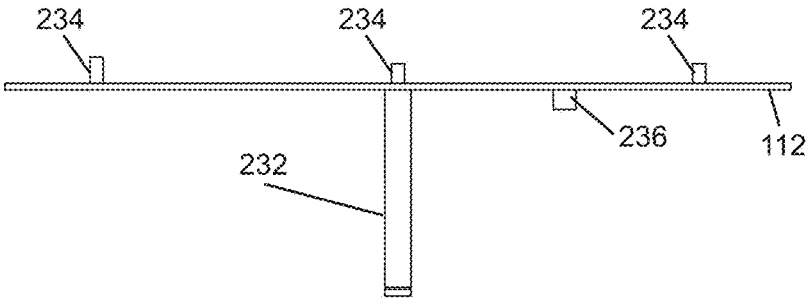
FIG. 6*b* illustrates a side view of a foot plate of the exercise apparatus according to an exemplary embodiment of the present disclosure.
Figure 6C:
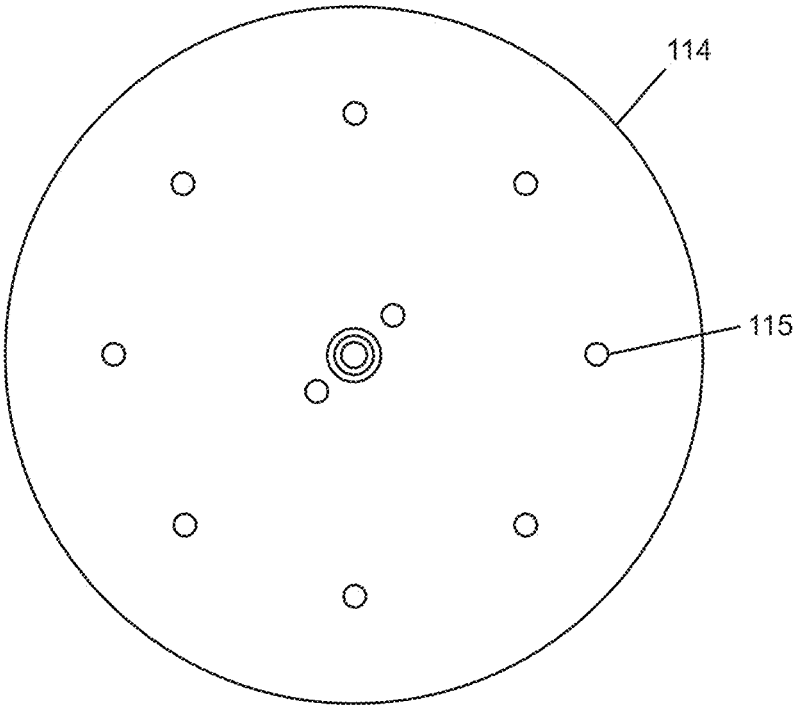
FIG. 6*c* illustrates a top view of a base plate of the exercise apparatus according to an exemplary embodiment of the present disclosure.

In some exemplary embodiments, the foot plate 112 can be locked at 45 degree intervals in the clockwise and counterclockwise direction on the base plate 114. As shown in FIGS. 6(*a*)-6(*c*), the foot plate 112 includes a rod 232 that is secured to a bottom center of the foot plate 112. The rod 232 is inserted through a circular hole at a center of the base plate 114 and placed through a circular hole in the base frame 116 to secure the base plate 114 and the foot plate 112 to the base frame 116. The bottom portion of the foot plate 112 has a tapered pin 236 that corresponds to a hole (not shown) in the base plate 114 to secure the foot plate 112 to the base plate 114.

Eight holes 115 are provided on the surface of the base plate 114 at an equal distance from each other that correspond to a desired position of the tapered pin 236, such that a user can lift the foot plate 112 off the base plate 114 to release the tapered pin 236 from the base plate 114. Then, the user can rotate the foot plate 112 at any 45 degree interval and place the tapered pin 236 into one of the eight holes 115 on the base plate 114, to lock and secure the foot plate 112 onto the base plate 114. More or less holes 115 can be provided on the base plate 114 to provide more positions of the foot plate 112 on the base plate 114 (e.g., 12 holes at 30 degree intervals), and the exemplary embodiments are not limited by any number of holes on the base plate 114.

The tapered pin 236 has a slight taper at an approximately 3 degree angle from the point it is secured to the foot plate 112 downward. The angle can range from 1 degree to 5 degrees. This provides less slack on the exercise apparatus 100 when doing various exercises such as terminal flicks (fast and quick movements). The corresponding holes on the base plate 114 can be cut on a chamfer machine allowing for a secure connection of the hole with the tapered pin 236. The top of the foot plate 112 has threaded rods 234 spaced equally apart on which the support plates 118 and 120 are provided on top of the slots 124, as described above. The threaded knobs 128 are then secured to the threaded rods 234.

Figure 4A:
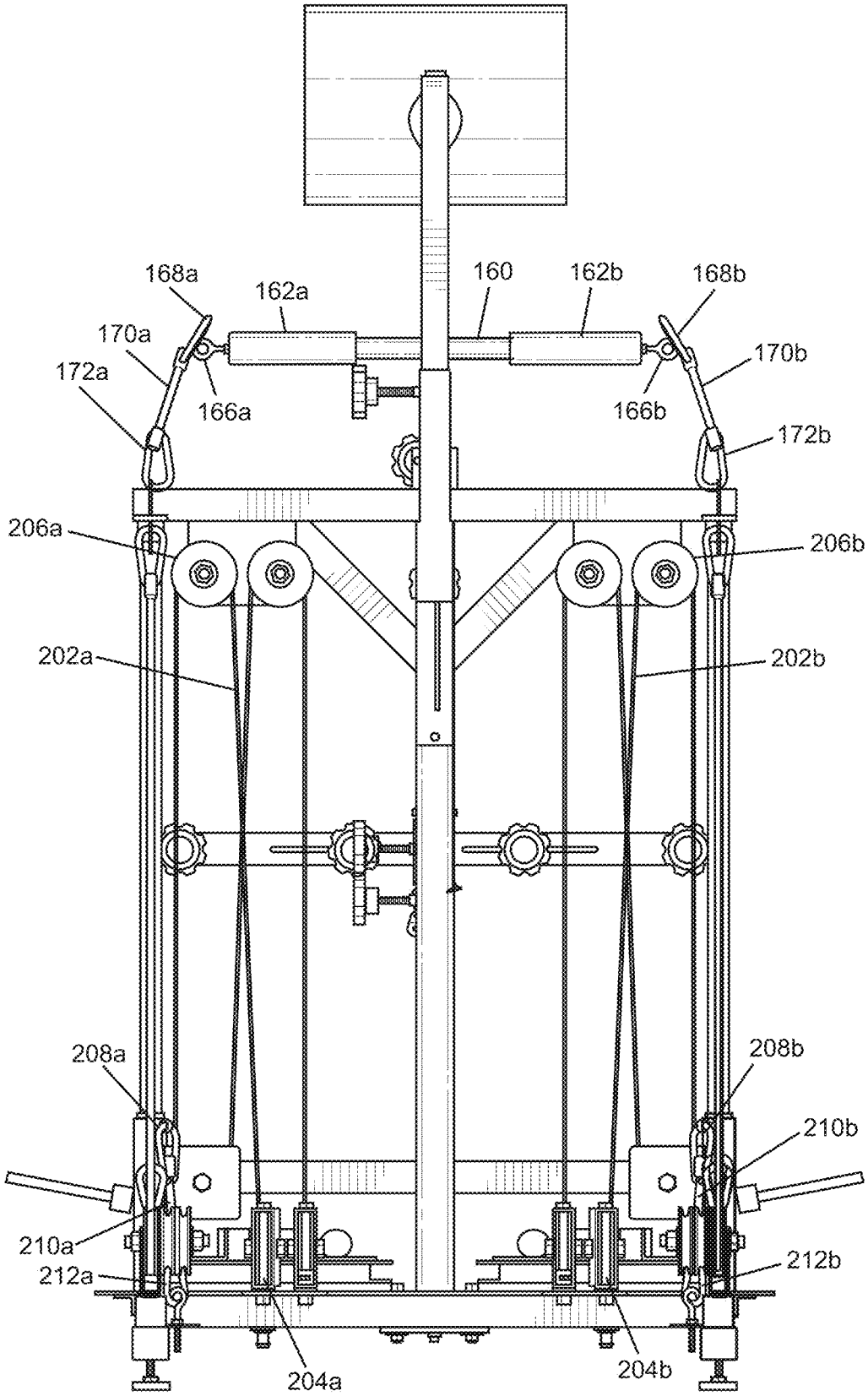
FIG. 4A is a rear view of an exercise apparatus according to an exemplary embodiment of the present disclosure.
Figure 4B:
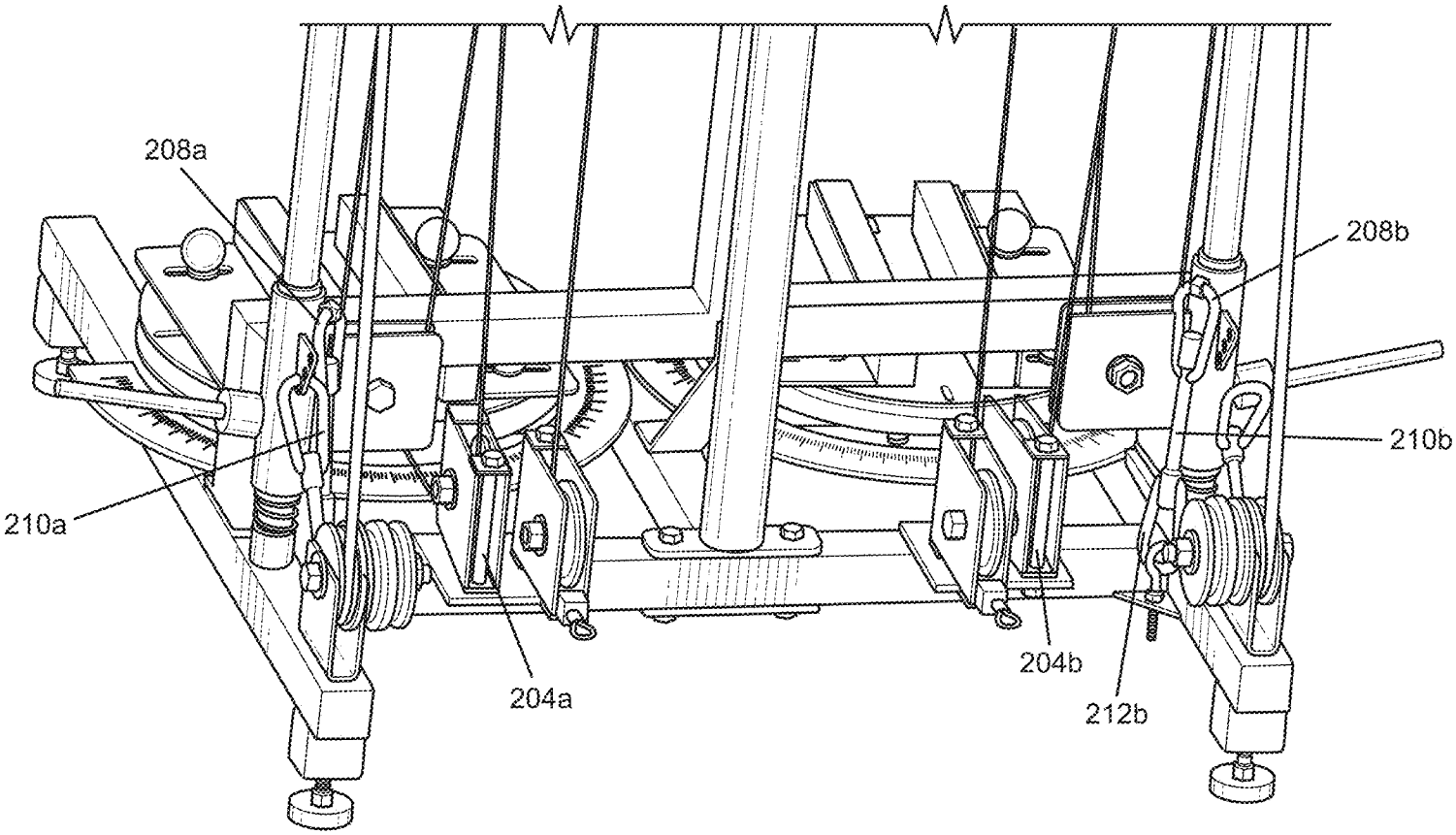
FIG. 4B is a portion of a rear perspective view of an exercise apparatus according to an exemplary embodiment of the present disclosure.

Various resistance can be provided using the foot plate system 110. As shown in FIGS. 4*a* and 4*b*, cable wires 202*a*, 202*b* can be connected to the foot plates 112. The cable wires 202*a*, 202*b* are each connected at one end to one of the foot plates 112, through pulleys 204*a*, 204*b* and upward to pulleys 206*a*, 206*b*, and then downward to a second end connected to clips 208*a*, 208*b*. Clips 208*a*, 208*b* can be connected to resistance tubing 210*a*, 210*b* (e.g., Cando® tubing), which is connected at a second end to clips 212*a*, 212*b*. The resistance tubing can be changed as needed to provide different resistances and strengths depending on the user and the exercise.

An example of how a person would use the foot plate system 110 would be to lift up the foot plate 112 from the base frame 116, move the indicator line on the foot plate 112 clockwise until the 45 degrees mark on the plate angle indicator 130, and then release and lock the foot plate 112 on the base plate 114 at that location. The therapist can then assess range of motion and strength. When training for strength, the therapist can assist the user helping them reach further degrees of movement. The user would place his foot on the foot plate 112 and try to rotate the foot plate 112 (and base plate 114) counterclockwise forty five degrees until the indicator line reaches the 0 degree mark on the plate angle indicator 130. A second way to use the foot plate system is to begin terminal flicks, which can be done by moving the foot plate 112 clockwise or counterclockwise 5-10 degrees with respect to the base plate frame 116, and having the user turn the foot plate 112 back and forth very quickly from the 5-10 degrees mark back and forth to the 0 degree mark. This can cause the user to quickly interchange concentric to eccentric contractions to improve motor control function to the muscles. Various resistance tubing can be used to provide different resistances as needed for the different exercises.

The foot plate system 110 can be used in a standing or sitting position. In some exemplary embodiments, when the user is in a sitting position, a knee support 140 can be provided to be used in conjunction with the foot plate system 110. The knee support 140 comprises a support bracket 142, which can have an adjustable height and depth on the exercise apparatus. Slots 148 can be provided on the support bracket 142 to work in conjunction with handles 146 to adjust for various knee widths. The handles can be loosened by turning the handles 146 counterclockwise to adjust the width, moving the handles 146 inward or outward along the width of the support bracket 142 as desired, then turning the handles 146 clockwise to tighten the handles 146. This can provide stabilization of the knee while the foot rotating exercises are performed. Handles 150 can be stationary at the ends of the support bracket 142, such that the knees fit between handles 150 and handles 146. In some exemplary embodiments, as shown in FIG. 3A, knobs 143 can be provided at the ends of handles 146 and 150 to secure them to the support bracket 142. In some exemplary embodiments, padding (e.g., foam) can be provided around the handles 146 and 150 to provide stabilization and comfort for the user.

In use, a user places their knees between the handles 146 and the padding 150 on the support bracket 142 when using the knee support 140 in a sitting position. The knee support 140 can keep the femur from adducting or abducting, and provide constant support and stability to the knees allowing a user to isolate internal and external support at the knee. By holding the knee in one place in a sitting position, the foot of the user is free to rotate in (inversion) or out (eversion), allowing a therapist to quickly identify compensations at the foot and ankle. The knee support 140 can help the user to train the kinetic chain to fire in a certain sequence which helps to reestablish the gate.

A quick release pin 158 allows you to move the knee attachment in a vertical plane and fits in corresponding holes in bracket 157, customizing to different leg heights with an attached lanyard allowing the user to easily adjust the height. Knob 156 allows tightening to bracket 157 to stabilize the support bracket 142. A quick release pin 154 allows you to move the support bracket 142 in a horizontal plane and fits in corresponding holes allowing for adjustment of the support bracket 142 in a horizontal plane, and knob 144 allows tightening to stabilize the support bracket 142.

In some exemplary embodiments, a twist bar 160 is provided for either individual exercises or joint exercises using the foot plate system 110. The twist bar 160 can have two opposing handles 162*a*, 162*b* for a user to grip. A knob 164 secures the twist bar 160 to the exercise apparatus 100, and allows the twist bar 160 to be raised, lowered and removed if desired. The ends 166*a*, 166*b* of the handles 162*a*, 162*b* have circular hooks that are connected to clips 168*a*, 168*b*. The clips 168*a*, 168*b* can be connected to resistance tubes 170*a*, 170*b*, and the other ends of the resistance tubes 170*a*, 170*b* are connected to clips 172*a*, 172*b*, which are secured to the exercise apparatus 100.

Figure 7:
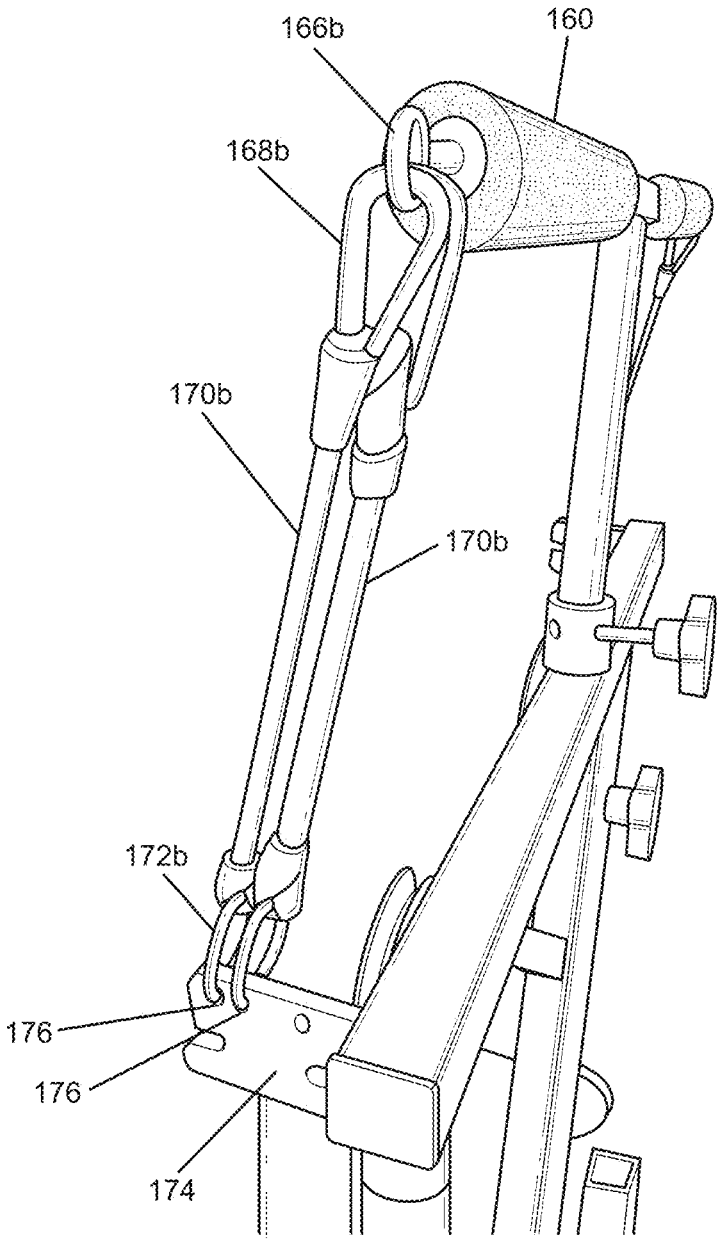
FIG. 7 illustrates a twist bar of the exercise apparatus according to an exemplary embodiment of the present disclosure.

As shown in FIG. 7, the resistance tubes 170*a*, 170*b* can be interchangeable, and more than one tube can be used (e.g., three tubes can be connected to clips 168*a*, 168*b* and clips 172*a*, 172*b*, and each tube can have the same or different resistances). For example, in some exemplary embodiments, a bracket 174 having one or more slots 176 can be mounted to the exercise apparatus 100. Each resistance tube 170*b* can be connected through a clip 172*b* to a slot 176. As shown in FIG. 7, two resistance tubes 170*b* are connected to two slots 176 of the bracket 174. Any number of slots can be provided on the bracket 174 and any number of resistance tubes can be used on either side of the twist bar 160, and the present disclosure is not limited to any number of slots on the bracket or number of type of resistance tubes.

Figure 7A:
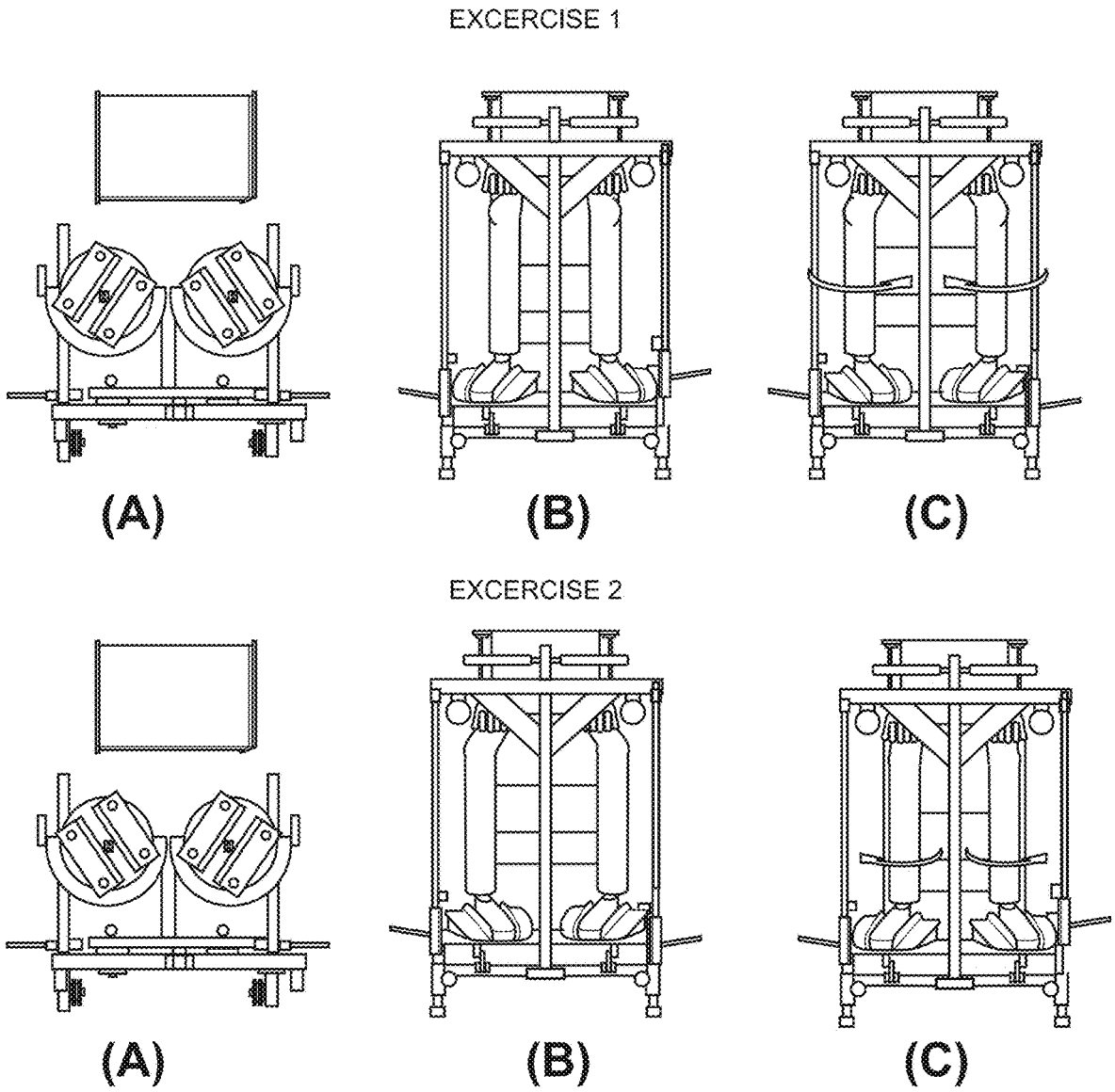
FIGS. 7A-7C illustrates various exercises that can be performed using the exercise apparatus according to the exemplary embodiments of the present disclosure.
Figure 7B:
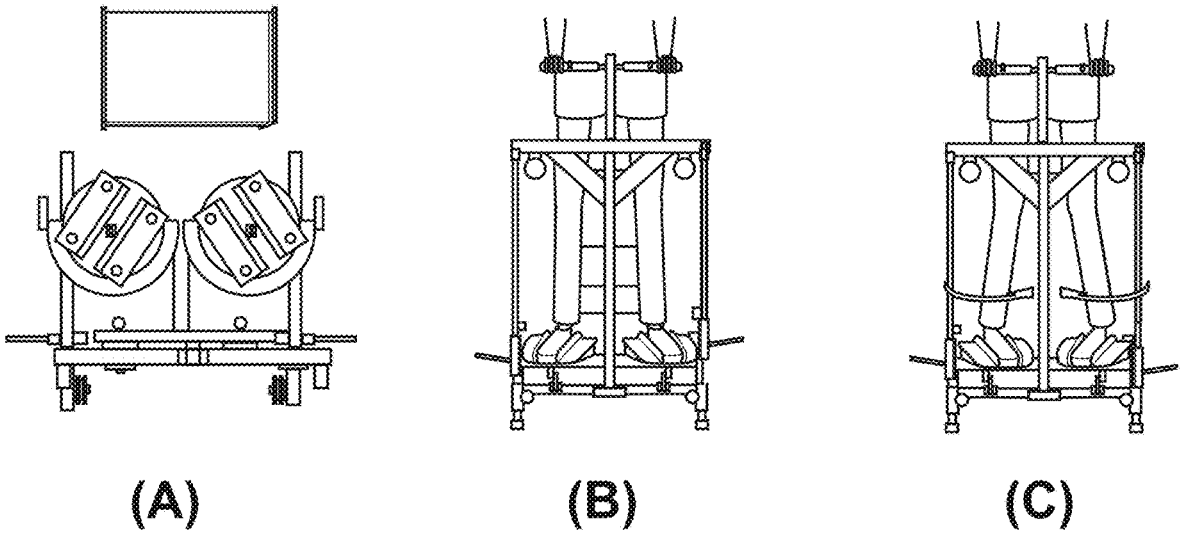
Figure 7B:
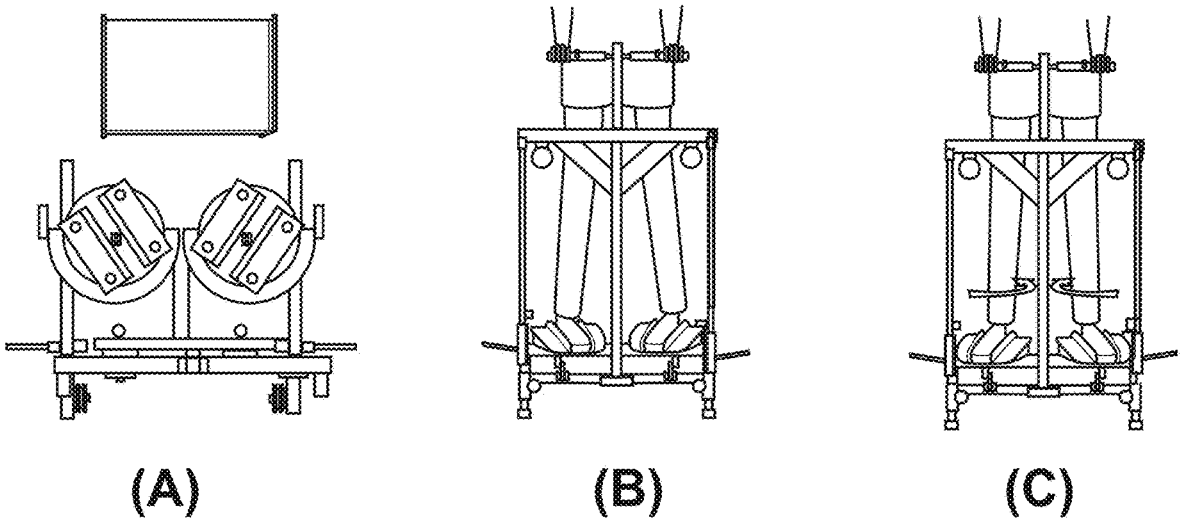
Figure 7C:
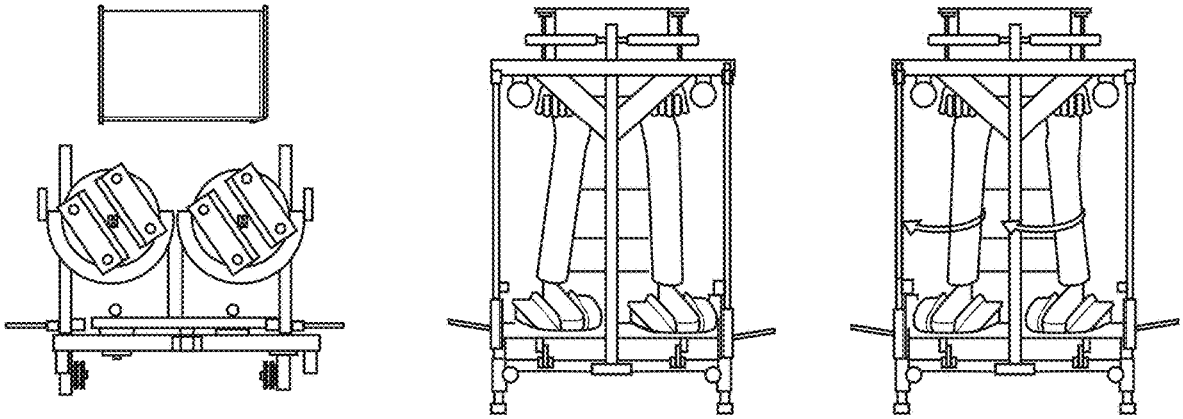
Figure 7C:
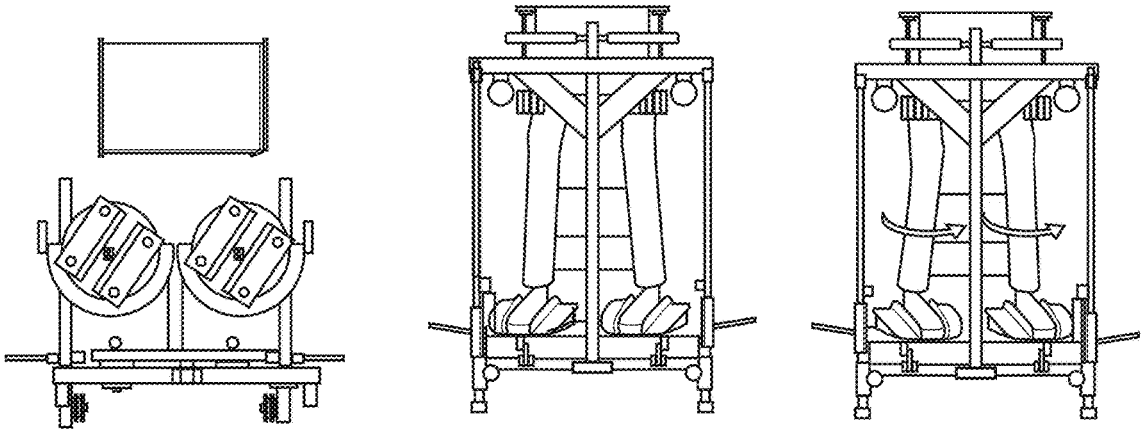

The twist bar 160 is designed to improve core stabilization and trunk rotation. It is also specifically designed to work with the foot plate system 110, and allows for different levels of resistance. The resistance bands provide light resistance for the beginner user and maximum resistance for the user who is stronger. The twist bar 160 trains for better trunk rotation to improve strength in the internal and external oblique and paraspinal muscles to help the trunk be more upright and also helps lateral movements. The twist bar 160 adds many unique training opportunities to the foot plate system 110 such as left hip stabilization. For example, when you rotate the left foot in you will load and strengthen your left adductors and left gluteus minimums, gluteus medias and TFL. When you rotate your right foot out you will load and strengthen the external rotator muscles of your right hip and femur. The resistance tubing on the ends of the twist bar 160 allow for the twist bar 160 to rotate with constant resistance, strengthening internal and external obliques and para spinal muscles. The twist bar 160 can extend upward providing more resistance and accommodating a taller individual. Various exercises can be performed using the exercise apparatus according to the exemplary embodiments of the present disclosure, as shown in, e.g., FIGS. 7A-7C.

In some exemplary embodiments, a back pulley system 180 can be provided at a rear portion of the exercise apparatus 100 as shown in FIGS. 3*a*-4*b*. Pulleys 222 are provided on upper and lower portions where cable wires are provided through to which various handles can be provided for various exercises. One end of the cable wires can connect to foot plates 112, can run through the pulleys 222, and end at clips 224. The clips 224 can then connect to, e.g., ankle cuffs or handles where various exercises can be performed for the feet, arms and back.

Figure 8:
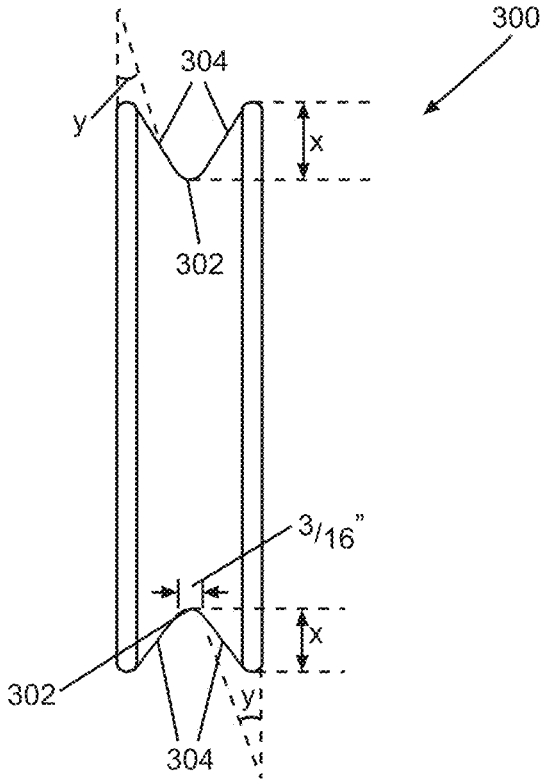
FIG. 8 illustrates a pulley of the exercise apparatus according to an exemplary embodiment of the present disclosure.

Each pulley (pulleys 22 and pulleys 204*a*, 204*b*, 206*a*, 206*b*) can be constructed as shown in FIG. 8. The pulley 300 can have side walls 304 that culminate in a valley 302 on both an upper end and a lower end as shown in FIG. 8. The side walls 304 are provided at an angle Y that can range from approximately 27 degrees to approximately 31 degrees, and can be approximately 29 degrees. The depth x of the valley 302 with respect to the top of the pulley 300 can range from approximately between 0.4 inches to approximately 0.6 inches, and can be approximately 0.5 inches. The flat or horizontal portion of the valley 302 is approximately 3/16 inches, which can allow a more secure fit with the cable wire.

This angle and depth can provide a novel pulley that is wider at a top portion. The angle can force a cable to stay on track within the pulley without drag friction on both sides, and can prevent a cable wire from slipping within the pulley. This angle and depth allow the cable wire to rest deep enough inside the pulley 300 so the cable wire will not constantly rub on the pulley 300. This can help to eliminate any drag or lag on the cable wires, and forces the cable wire to sit on the valley 302 with less drag and prevents slip.

Figure 9:
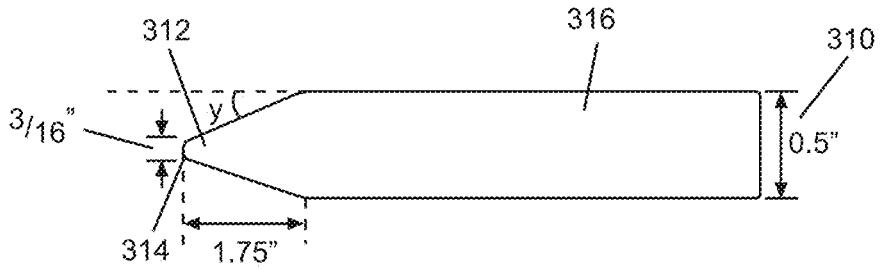
FIG. 9 illustrates a pulley tool of the exercise apparatus according to an exemplary embodiment of the present disclosure.

In order to construct the pulley 300 described above, a pulley tool 310 as shown in FIG. 9 can be provided having a body portion 316 and a top portion 312. The top portion 312 is used to create the depth and angle of the pulley 300 described above. The pulley tool can have a length of approximately 3 inches to approximately 4 inches, and can be 3.25 inches, and can have a bottom width of about 0.5 inches. The top portion 312 of the pulley tool 310 can have tapered walls that extend to a tip 314. The tapered walls are tapered at an angle Y that is approximately 27 degrees and approximately 31 degrees, and can be approximately 29 degrees, corresponding to the angle created for the pulley 300 described above. The length of the top portion can be approximately 1.75 inches. The tip 314 of the top portion 312 can have a width of approximately 3/16 inches, that creates the flat or horizontal portion of the valley 302 of the pulley 300 described above. The pulley tool 300 can be constructed of a high speed steel cobalt material.

Using the pulleys 300 described above, the back pulley system 180 can allow a user to train the upper body and lower body by using constant resistance through a short range of motion. A user is able to train flexion and extension of the hip as well as abduction and adduction of the hip. Adding resistance tubing to the pulleys 300 can provide constant resistance. The back pulley system 180 provides the ability to allow a user a total body workout.

Figure 10:
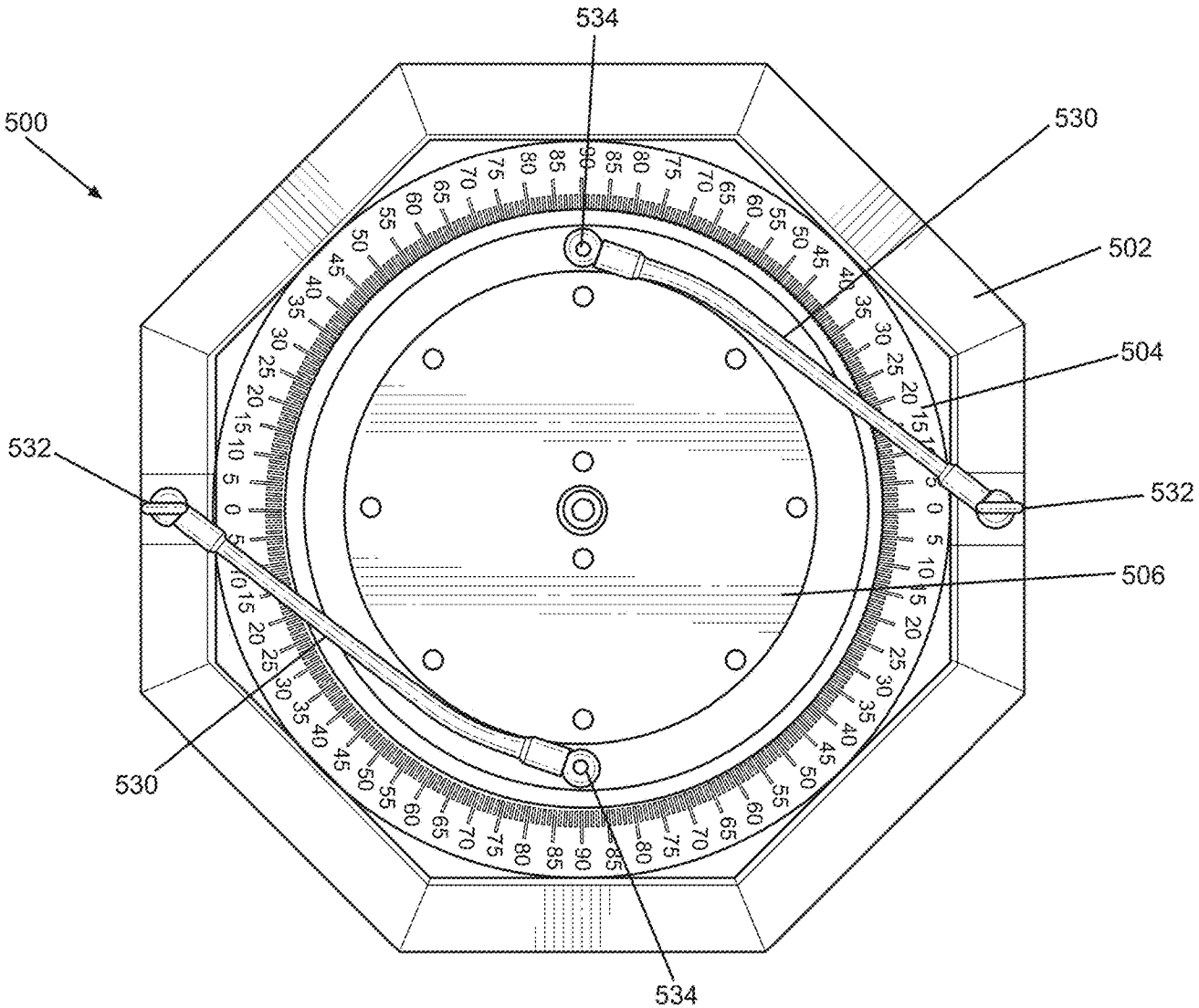
FIG. 10 illustrates a top view of a portable exercise apparatus according to an exemplary embodiment of the present disclosure.
Figure 11:
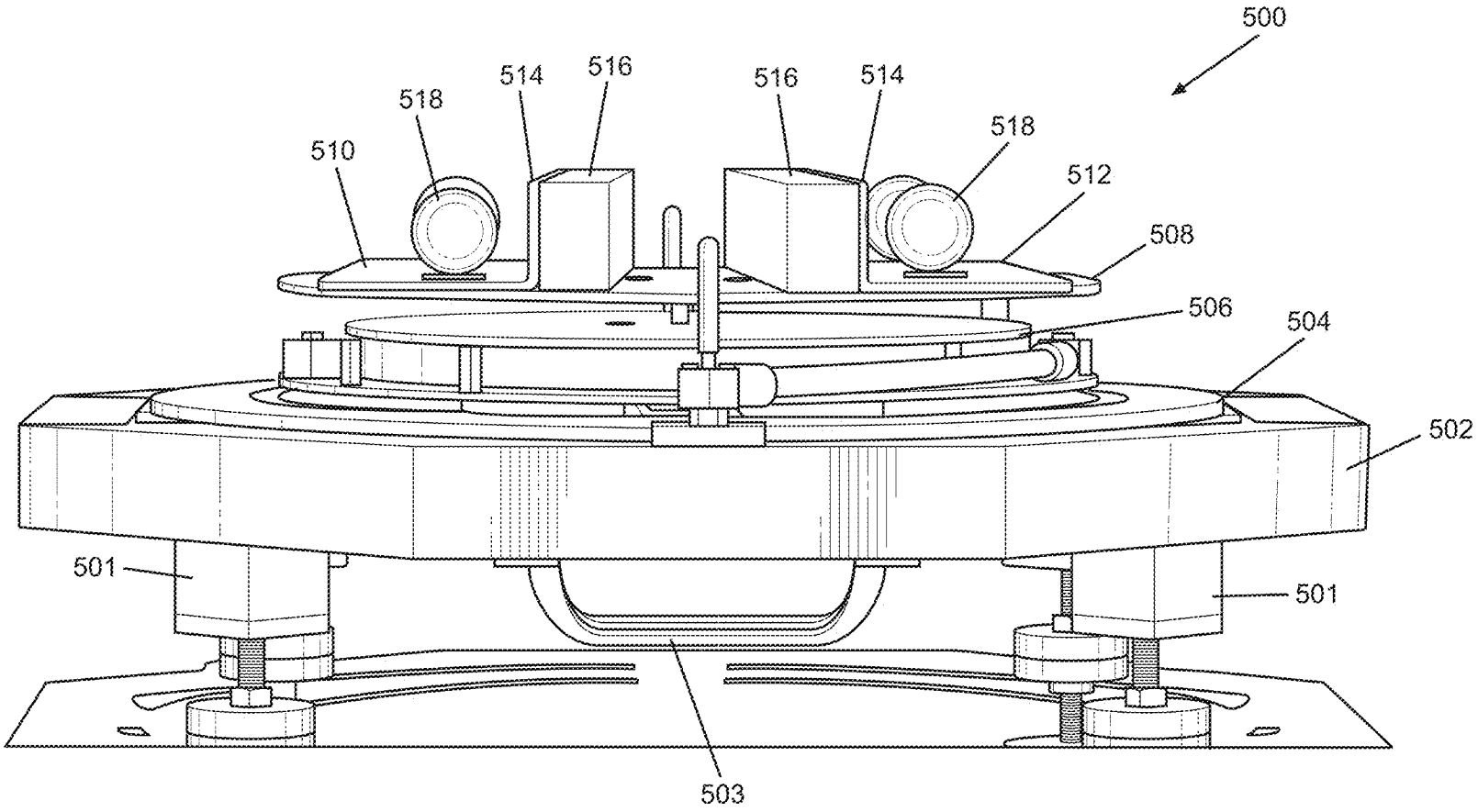
FIG. 11 illustrates a side view of the portable exercise apparatus of FIG. 10 according to an exemplary embodiment of the present disclosure.

In some exemplary embodiments, as shown in FIGS. 10-11, a portable foot exercise apparatus 500 can be provided which can provide a portable version for users or trainers, which can allow for rotational training with resistance tubing for constant resistance. The portable apparatus 500 can have a frame 502 that sits on one or more stands 501, which can have foot levelers to allow for leveling of the portable apparatus when on uneven ground. A handle 503 can be provided on the bottom side for carrying the portable apparatus 500. An angle indicator plate 504 can be provided on top of the frame 502 that is stationary. A base plate 506 can be provided that rotates with respect to the frame 502 and angle plate 504. A foot plate 508 is provided above the base plate 506, and a left support plate 510 and right support plate 512 can be provided on the foot plate 508 having a similar structure to the left support plate 118 and right support plate 120 above with respect to the exercise apparatus 100.

For example, the portable apparatus 500 comprises a foot plate 508 which is provided on top of and secured to a base plate 506, such that the foot plate 508 and base plate 506 can rotate with respect to the angle plate 504 and the frame 502. A left support plate 510 and a right support plate 512 are provided on top of the foot plate 508. The left support plate 510 and right support plate 512 have a vertically extending wall 514. The left support plate 510 and right support plate 512 can have one or more slots through which threaded knobs 518 secure the left support plate 510 and right support plate 512 to the foot plate 508. Two vertically extending walls 514 are provided on each of the left support plate 510 and right support plate 512, such that a user's foot can be placed between the vertically extending walls 514 of the left support plate 510 and right support plate 512. In some exemplary embodiments, padding 516 such as foam can be provided inward of the vertically extending walls 514 such that a user can place his foot between the padding 516 of the vertically extending walls 514 of the left support plate 510 and the right support plate 512. When a user turns his foot on the foot plate 508, the foot plate 508, left support plate 510 and right support plate 512, base plate 506 all turn in the same direction with respect to the angle plate 504 and frame 502.

The angle indicator plate 504 can allow a user (or therapist and user) to measure a user's range of motion. Similar as in the exercise apparatus 100, a locking mechanism is provided between the foot plate 508 and base plate 506 such that a user can lift the foot plate 508 off of the base plate 506, and turn the foot plate 508 to a desired degree, which angle can be shown on the angle indicator plate 504. Then, the user can release the foot plate 508, which would then lock the foot plate 508 to the base plate 506 at that location. In some exemplary embodiments, the foot plate 508 can be locked at 45 degree intervals in the clockwise and counterclockwise direction on the base plate 506. Similar to the exercise apparatus 100, the bottom portion of the foot plate 508 can have a tapered pin 520 that corresponds to a hole in the base plate 506 to secure the foot plate 508 to the base plate 506. In some exemplary embodiments, a strap (not shown) can be provided over the padding 516 and connected between the left support plate 510 and right support plate 512 to allow a user to pick up his foot and lift the foot plate 508 from the base plate 506.

In some exemplary embodiments, eight holes can be provided on the surface of the base plate 506 around the circumference of the base plate 506 at an equal distance from each other that correspond to a desired position of the tapered pin 520, such that a user can lift the foot plate 508 off the base plate 506 to release the tapered pin 520 from the base plate 506. Then, the user can rotate the foot plate 508 at any 45 degree interval (in either direction) and place the tapered pin 520 into one of the eight holes on the base plate 506, to lock and secure the foot plate 508 onto the base plate 506. More or less holes can be provided on the base plate 506 to provide more positions of the foot plate 508 on the base plate 506 (e.g., 12 holes at 30 degree intervals), and the exemplary embodiments are not limited by any number of holes on the base plate 506.

Resistance tubing 530 can be provided on the portable apparatus 500 to provide resistance for training. In some exemplary embodiments, two resistance tubes 530 can be provided that connect to an eyelet 532 on the frame 502 at one end of the resistance tube 530. The second opposite end of the resistance tube can be connected to a pin 534 on the base plate 506. Any number of pins 534 can be provided on the base plate 506 that can provide for greater or less resistance of the resistance tubes 530 based on a stretched length of the resistance tubes 530. For example, additional pins 534 can provide for a greater or lesser length which can make the resistance greater or lesser. The resistance tubes 530 can provide constant resistance for inversion/internal knee rotation and eversion/external knee rotation, and the user can move the foot plate 508 (and base plate 506) in a clockwise or counterclockwise direction. Various resistance tubes 530 can be provided that can also provide for greater or lesser levels of resistance tubing. This can allow a person to progress from light resistance to heavy resistance as needed. The apparatus 500 can be used alone or in conjunction with another apparatus 500 for both feet together. It can be used in a sitting position (which can train the foot, ankle and knee) or in a standing position (which can train the hamstrings, IT band, adductors, hip and core).

Figure 12:
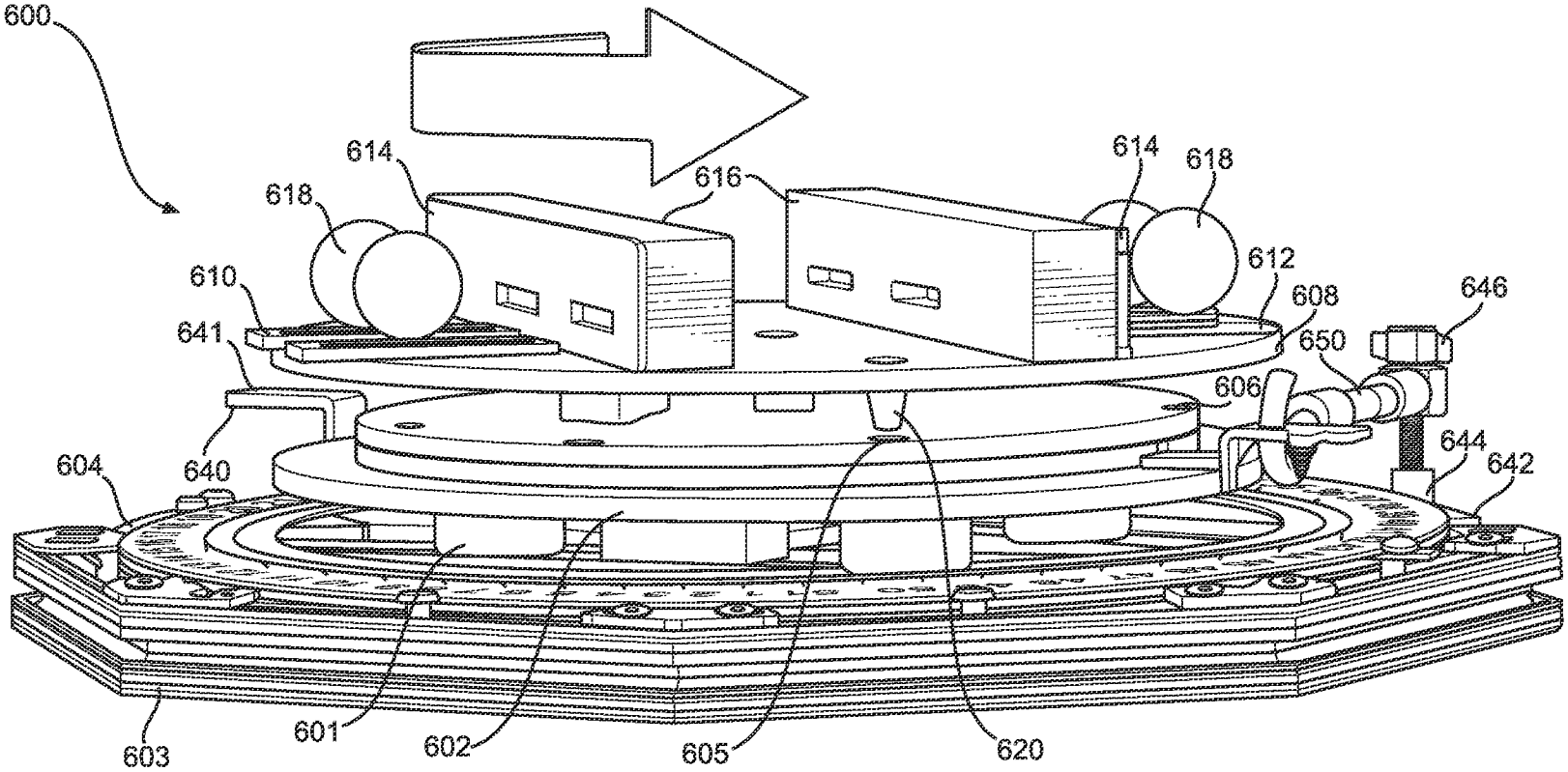
FIGS. 12-14 illustrates a portable exercise apparatus for rotational exercises according to an exemplary embodiment of the present disclosure.
Figure 13:
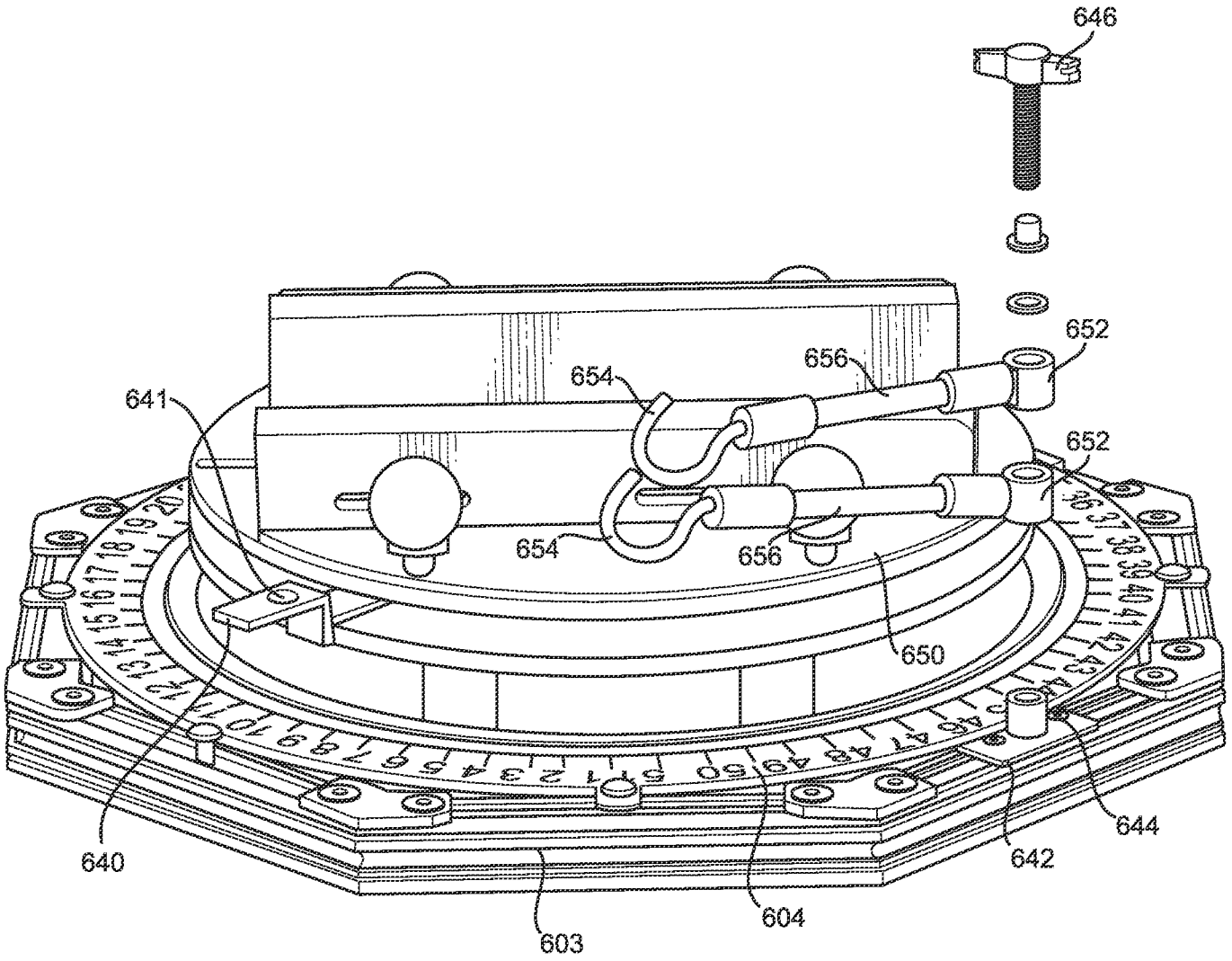
Figure 14:
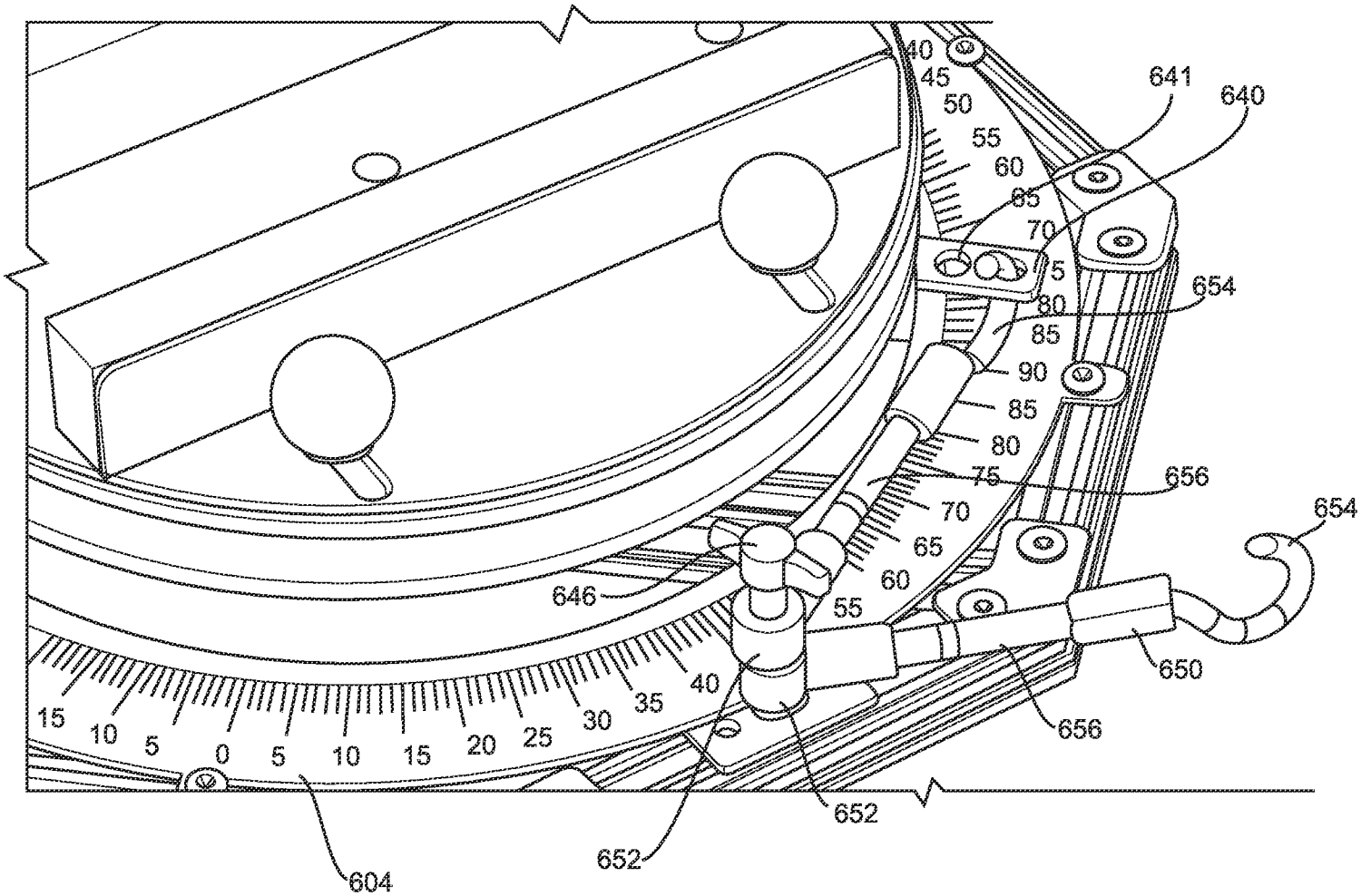

In some exemplary embodiments of the present disclosure, as shown in FIGS. 12-14, a portable foot exercise apparatus 600 can be provided which can provide a portable version for users or trainers, which can allow for rotational training with resistance tubing for constant resistance. The portable apparatus 600 can have a bottom plate 602 that sits on one or more stands 601, which are secured to a base 603. The stands 601 can be transference bearings, which can enhance the responsiveness of the foot plate 608 when rotated when the base plate 606 and bottom plate 602 are rotated simultaneously. The base 603 can have an octagonal or any other shape, such as but not limited to circular, square or rectangular. The base 603 can have a circumferential frame that can have a larger diameter than the structures placed on it. An angle indicator plate 604 can be provided on top of the base 603 that is stationary. The angle indicator plate 604 can have a diameter less than the base 603.

A base plate 606 can be provided that is secured or welded to the bottom plate 602, and rotates along with bottom plate 602 with respect to the base 603 and angle plate 604. A foot plate 608 is provided above the base plate 606, and a left support plate 610 and right support plate 612 can be provided on the foot plate 608 having a similar structure to the left support plate 118 and right support plate 120 above with respect to the exercise apparatus 100. The bottom plate 602, base plate 606 and foot plate 608 can have but are not limited to a circular shape, and can have a smaller diameter than the angular plate 604 so that the angular plate 604 is visible from above. In some exemplary embodiments, the base plate 606 can have a smaller diameter than the bottom plate 602 and the foot plate 608.

For example, the portable apparatus 600 comprises a foot plate 608 which is provided on top of and secured to a base plate 606, such that the foot plate 608, base plate 606 and bottom plate 602 can rotate with respect to the angle plate 604 and the base 603. A left support plate 610 and a right support plate 612 are provided on top of the foot plate 608. The left support plate 610 and right support plate 612 have a vertically extending wall 614. The left support plate 610 and right support plate 612 can have one or more slots through which threaded knobs 618 secure the left support plate 610 and right support plate 612 to the foot plate 608. Two vertically extending walls 614 are provided on each of the left support plate 610 and right support plate 612, such that a user's foot can be placed between the vertically extending walls 614 of the left support plate 610 and right support plate 612. In some exemplary embodiments, padding 616 such as foam can be provided inward of the vertically extending walls 614 such that a user can place his foot between the padding 616 of the vertically extending walls 614 of the left support plate 610 and the right support plate 612. When a user turns his foot on the foot plate 608, the foot plate 608, left support plate 610 and right support plate 612, base plate 606 and bottom plate 602 all turn in the same direction with respect to the angle plate 604 and base 603.

The angle indicator plate 604 can allow a user (or therapist and user) to measure a user's range of motion. Similar as in the exercise apparatus 500 and 100, a locking mechanism is provided between the foot plate 608 and base plate 606 such that a user can lift the foot plate 608 off of the base plate 606, and turn the foot plate 608 to a desired degree, which angle can be shown on the angle indicator plate 604. Then, the user can release the foot plate 608, which would then lock the foot plate 608 to the base plate 606 at that location. In some exemplary embodiments, the foot plate 608 can be locked at 45 degree intervals in the clockwise and counterclockwise direction on the base plate 606. Similar to the exercise apparatus 100 and 500, the bottom portion of the foot plate 608 can have a tapered pin 620 that corresponds to a hole 605 in the base plate 606 to secure the foot plate 608 to the base plate 606. In some exemplary embodiments, a strap (not shown) can be provided over the padding 616 and connected between the left support plate 610 and right support plate 612 to allow a user to pick up his foot and lift the foot plate 608 from the base plate 606.

In some exemplary embodiments, multiple holes (e.g, 4 or 6 or 8) 605 can be provided on the surface of the base plate 606 around the circumference of the base plate 606 at an equal distance from each other that correspond to a desired position of the tapered pin 620, such that a user can lift the foot plate 608 off the base plate 606 to release the tapered pin 620 from the base plate 606. Then, the user can rotate the foot plate 608 in either direction and place the tapered pin 620 into one of the holes 605 on the base plate 606, to lock and secure the foot plate 608 onto the base plate 606. More or less holes 605 can be provided on the base plate 606 to provide more or less positions of the foot plate 608 on the base plate 606 (e.g., 8 holes at 45 degree intervals or 12 holes at 30 degree intervals), and the exemplary embodiments are not limited by any number of holes 605 on the base plate 606.

Resistance tubing can be provided on the portable apparatus 600 to provide resistance for training. In some exemplary embodiments, as shown in FIGS. 13-14, a metal plate 642 having a threaded hole 644 is secured to the base 603. One or more resistance elements 650 can be provided with resistance tubing 656 that is secured to a hollow end portion 652 at a first end and a hook 654 on an opposite end. A threaded bolt 646 is provided through the hollow end portion 652 and secured to the threaded hole 644 to secure the resistance element 650 to the base 603. One or more brackets 640 having one or more holes 641 are secured to the bottom plate 602, such as a top surface thereof. The hook 654 can be connected to one of the holes 641 on the brackets 640, so that resistance is provided when the bottom plate 602 is rotated (e.g., by rotating foot plate 608 and base plate 606) with respect to the base 603. In some exemplary embodiments, two resistance elements 650 can be secured to a single threaded bolt 646 that is secured to the threaded hole 644. That is, the threaded bolt 646 is provided through two hollow end portions 652 of two resistance elements 650, then secured to the threaded hole 644. The two hook 654 of the two resistance elements 650 can be secured to two holes 641 on the bracket 640, as shown in FIGS. 13-14.

Various resistance elements 650 can be provided that can also provide for greater or lesser levels of resistance tubing. This can allow a person to progress from light resistance to heavy resistance as needed. Each resistance element 650 can have a similar or different resistance, depending on the resistance tubing 656. The resistance tubing 656 can provide constant resistance for inversion/internal knee rotation and eversion/external knee rotation, and the user can move the foot plate 608 (and base plate 606 and bottom late 602) in a clockwise or counterclockwise direction.

Figure 15:
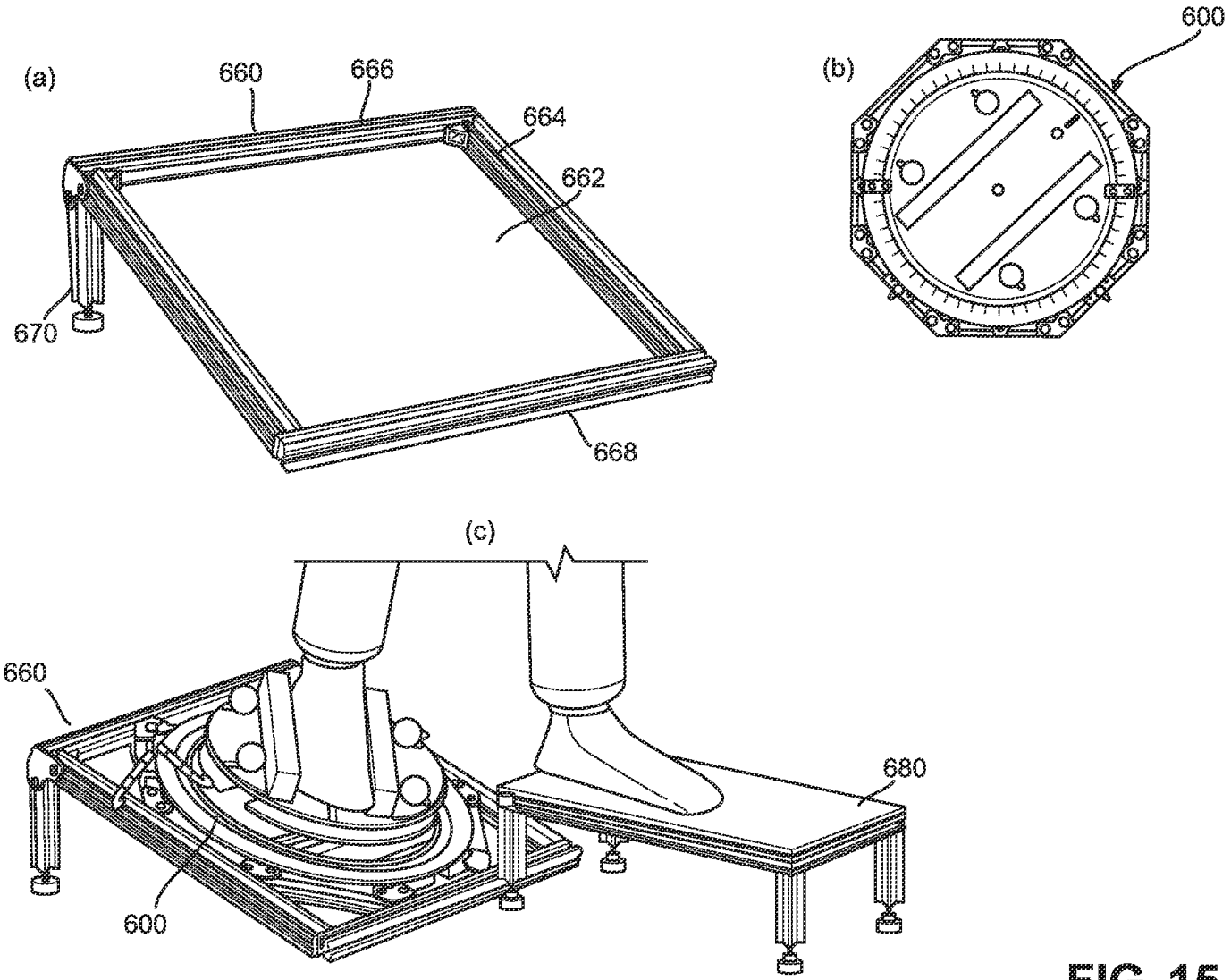
FIGS. 15(*a*)-15(*c*) illustrate a use of the portable exercise apparatus of FIGS. 12-14 according to an exemplary embodiment of the present disclosure.
Figure 16:
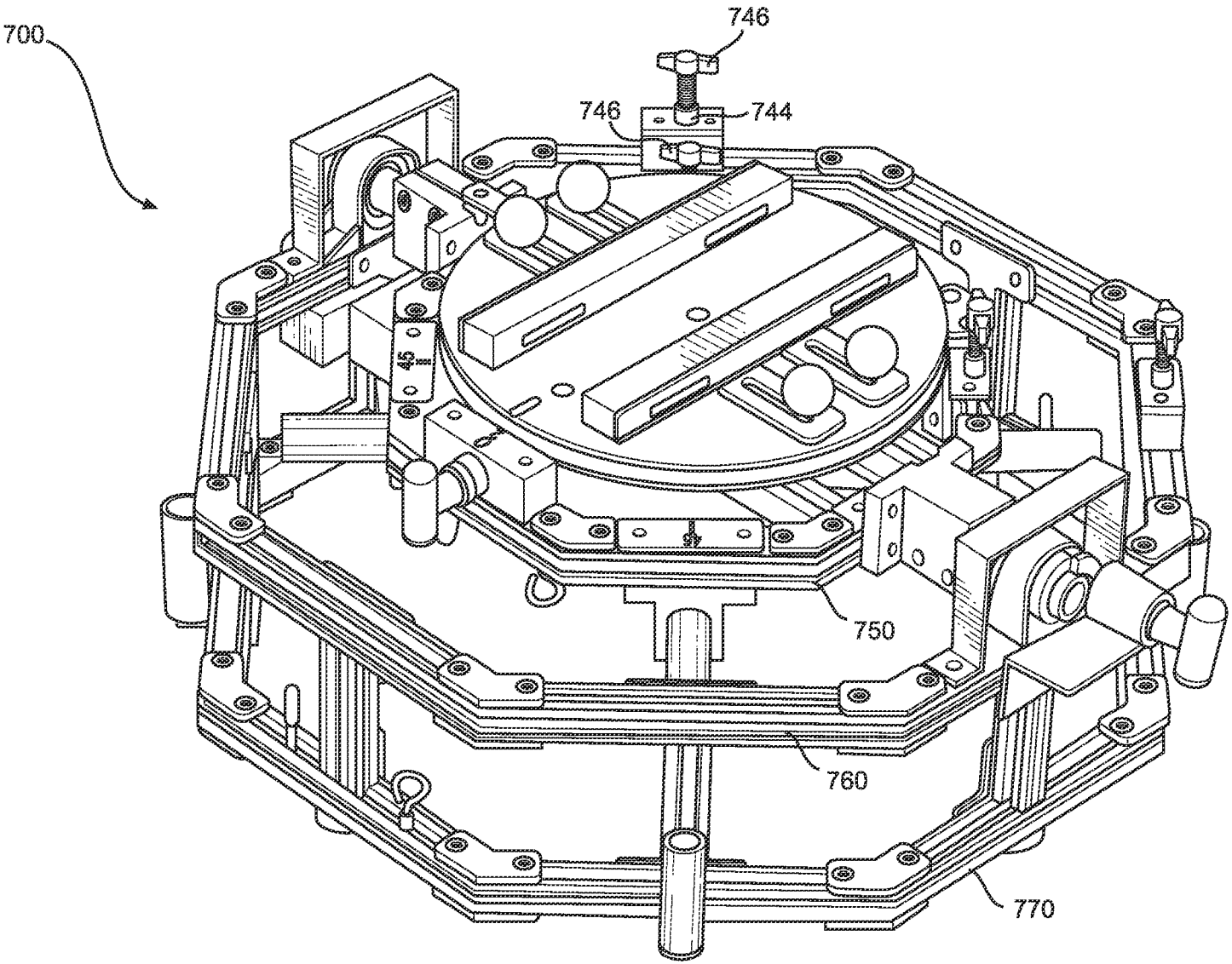
FIGS. 16-25 illustrate another portable exercise apparatus for rotational and pivoting exercises according to an exemplary embodiment of the present disclosure.
Figure 17:
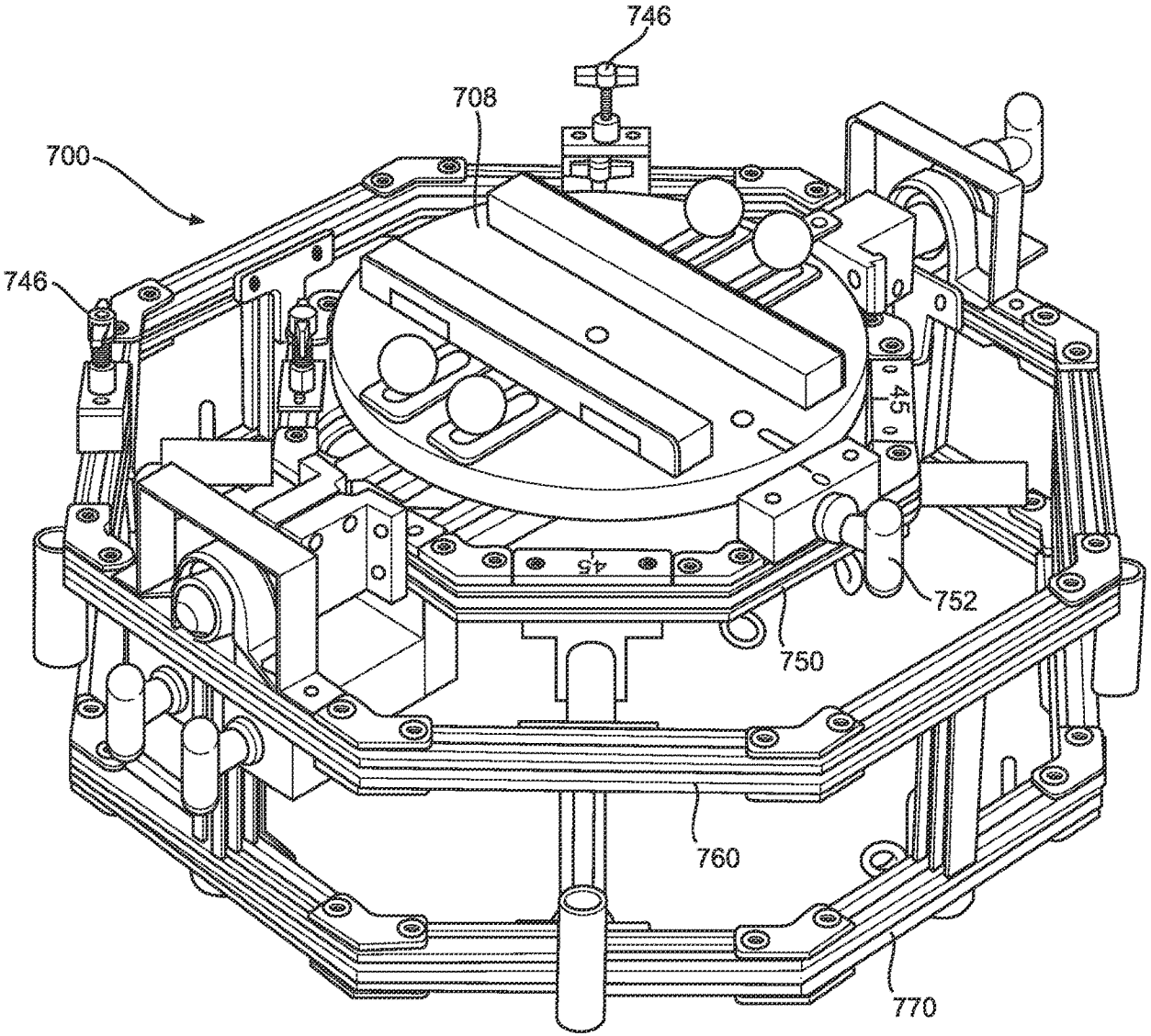
Figure 18:
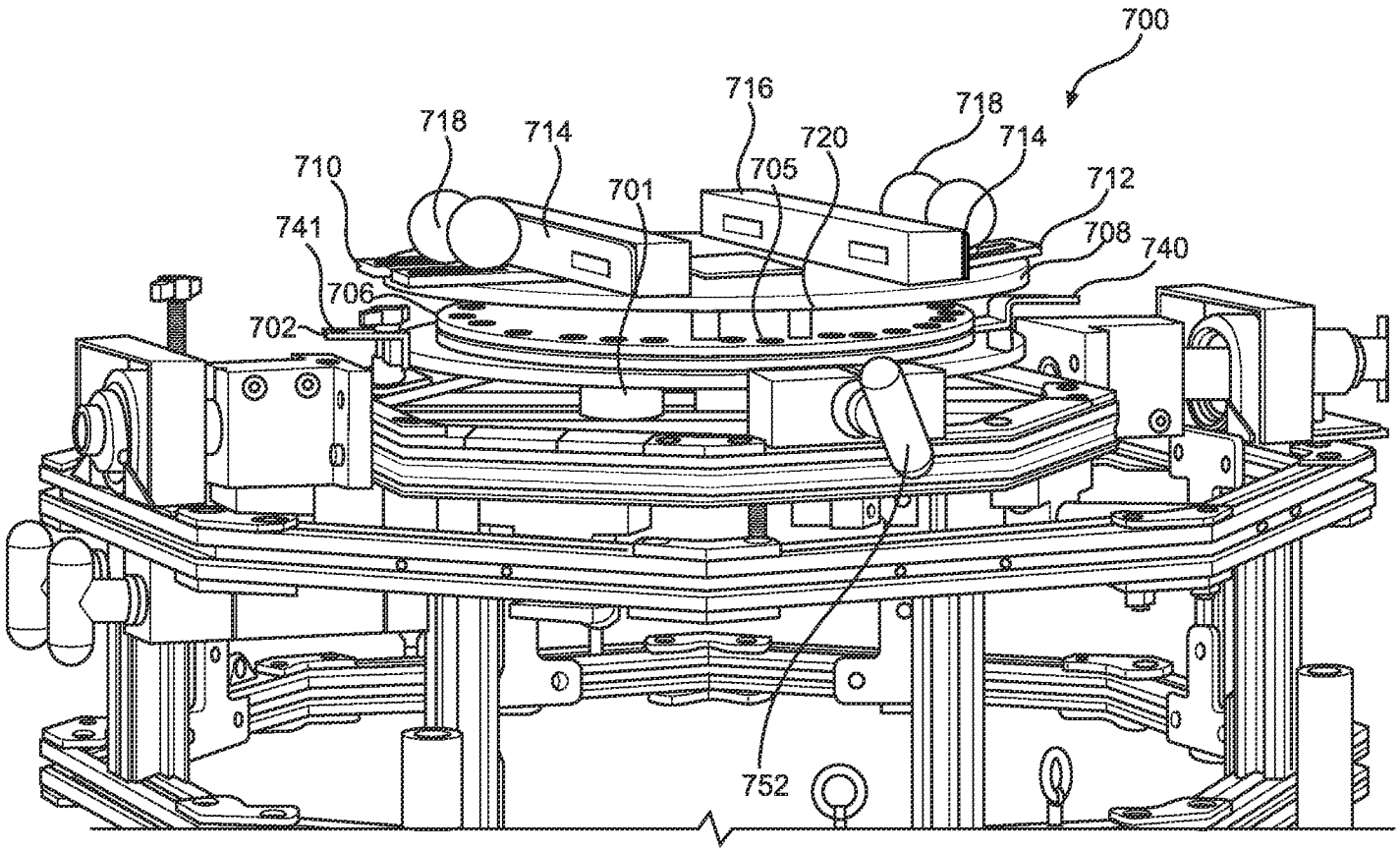
Figure 19:
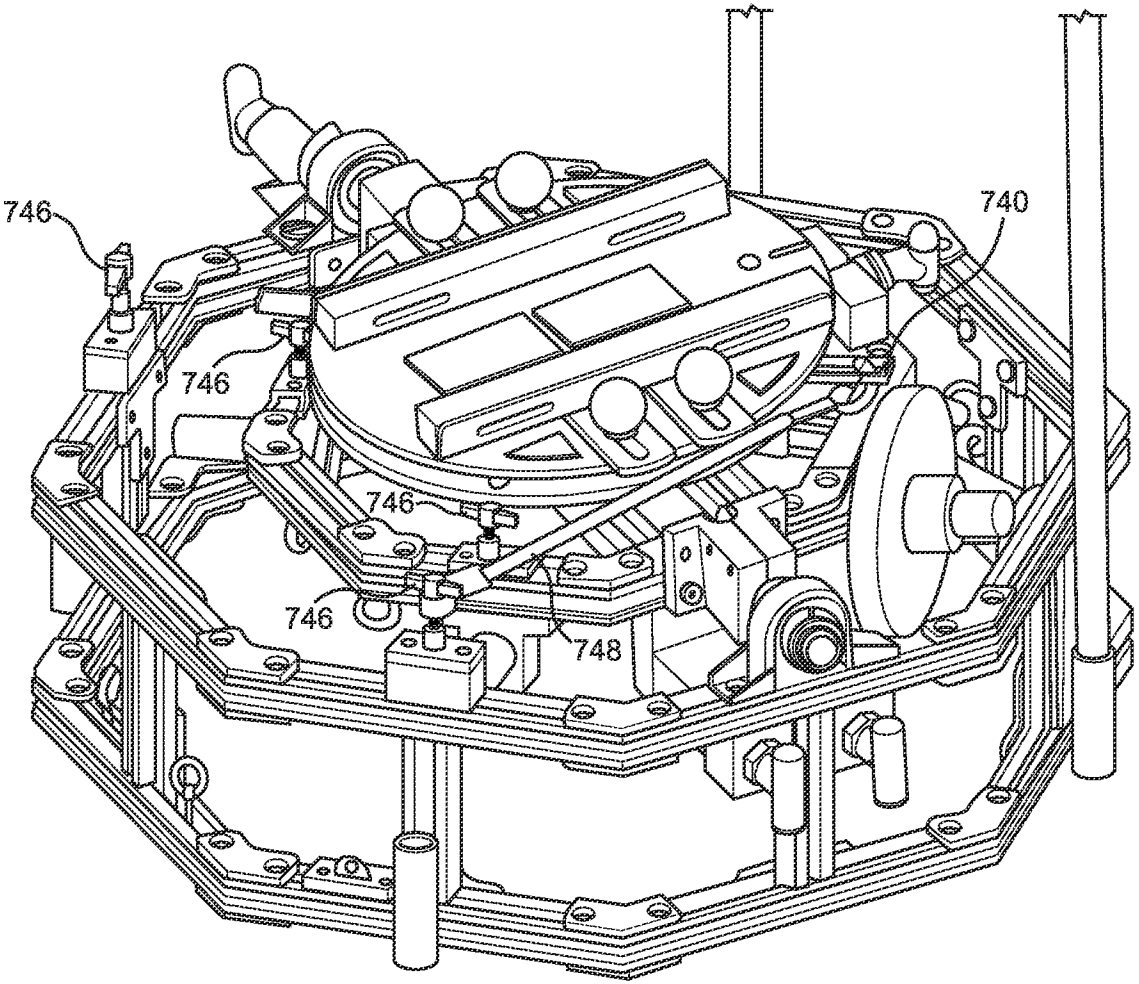
Figure 20:
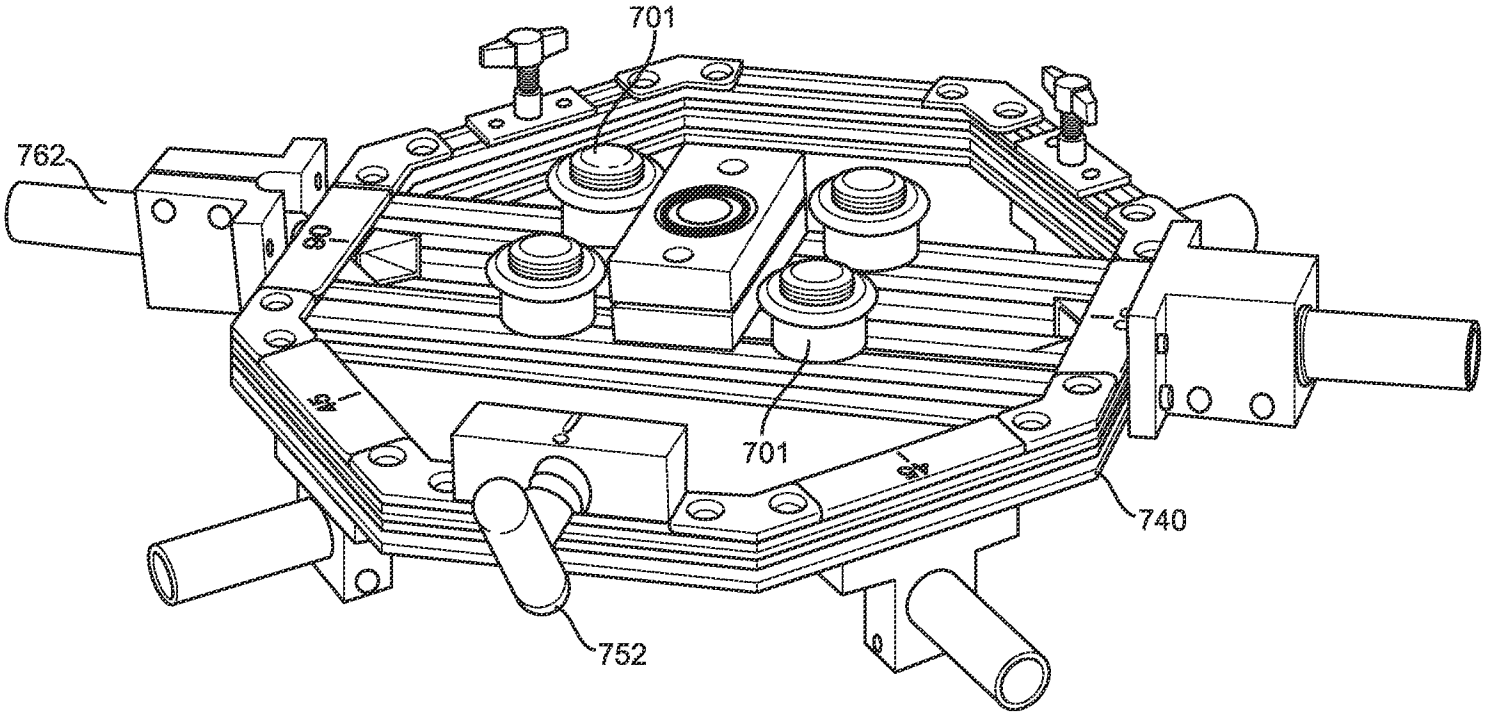
Figure 21:
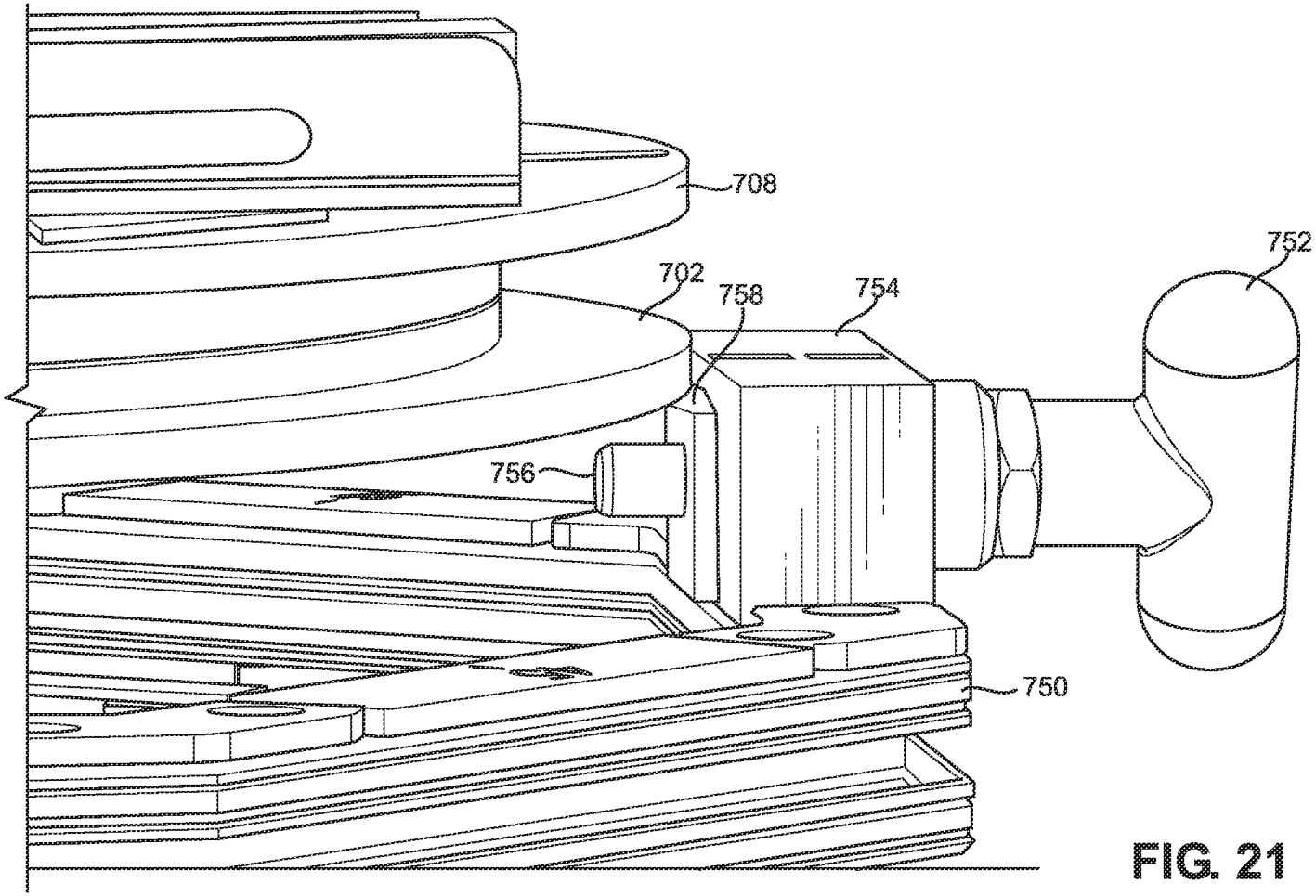
Figure 22:
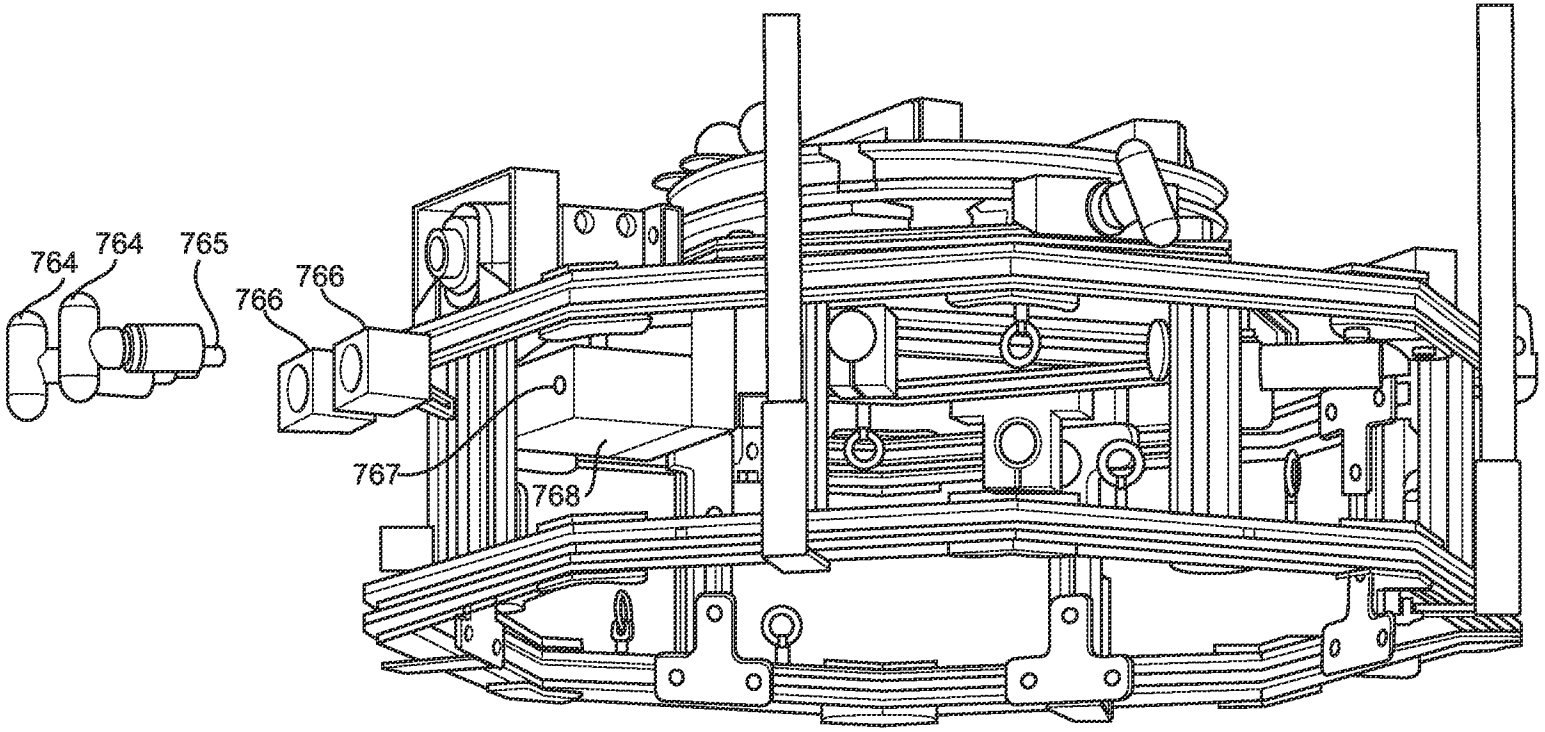
Figure 23:
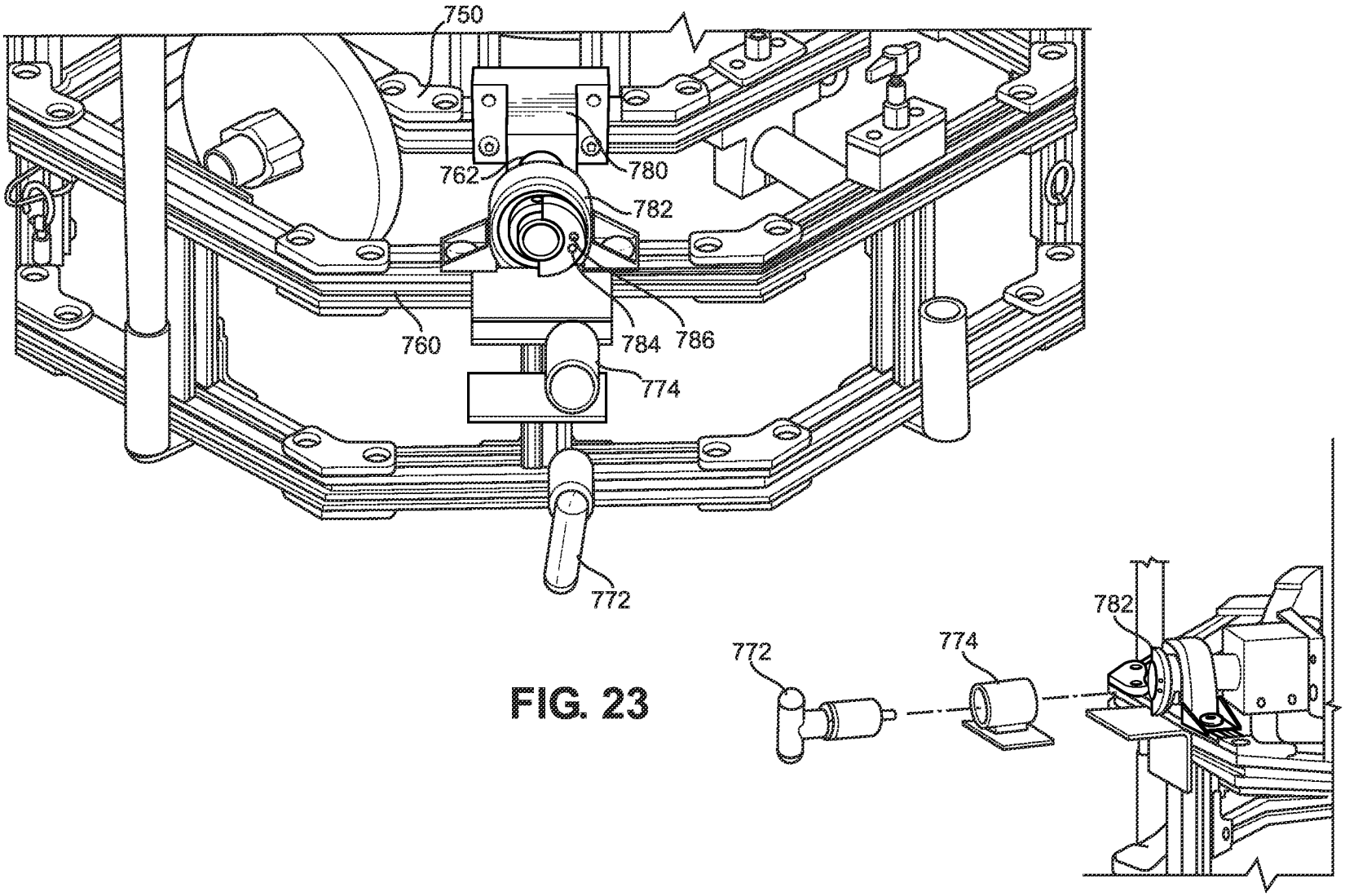
Figure 24:
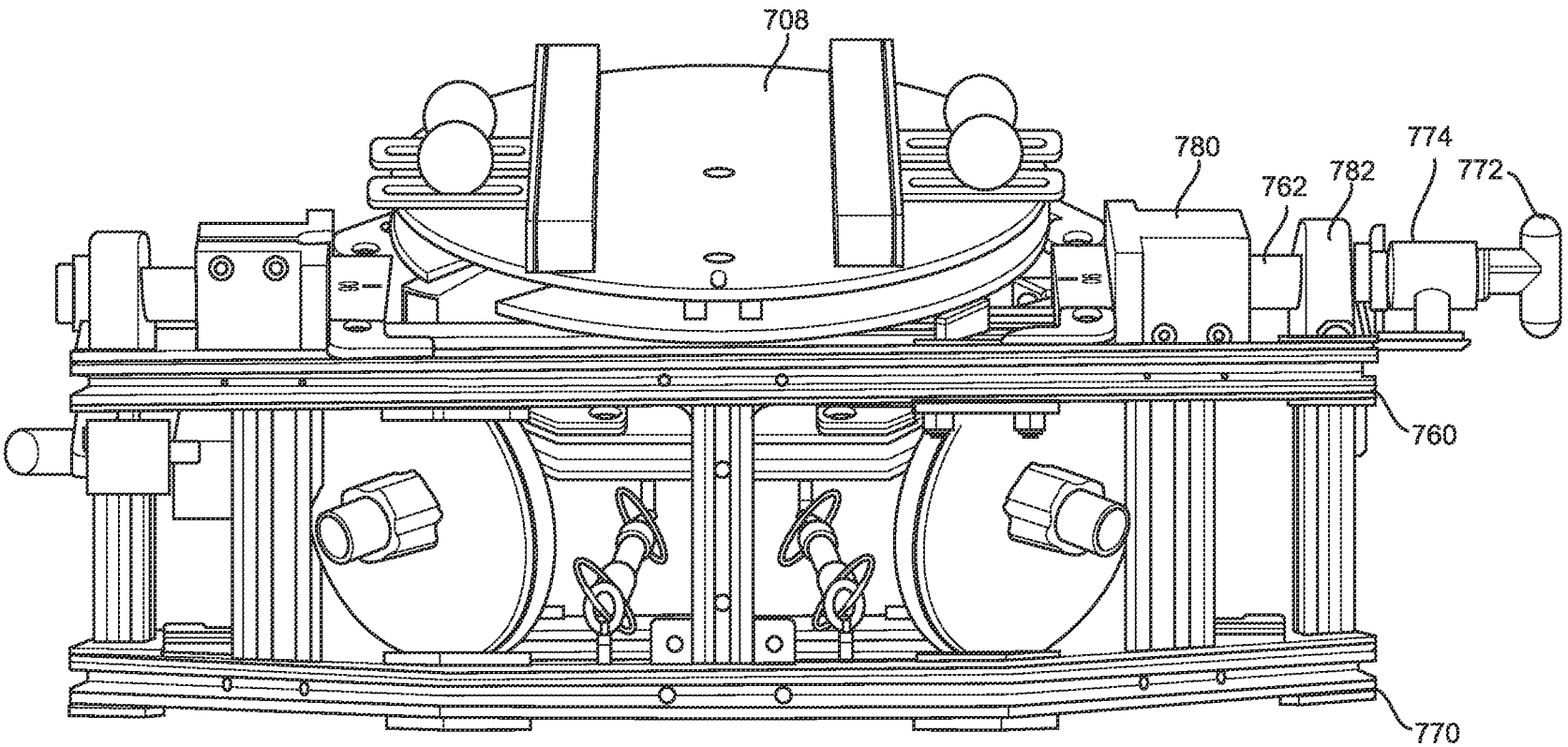
Figure 25:
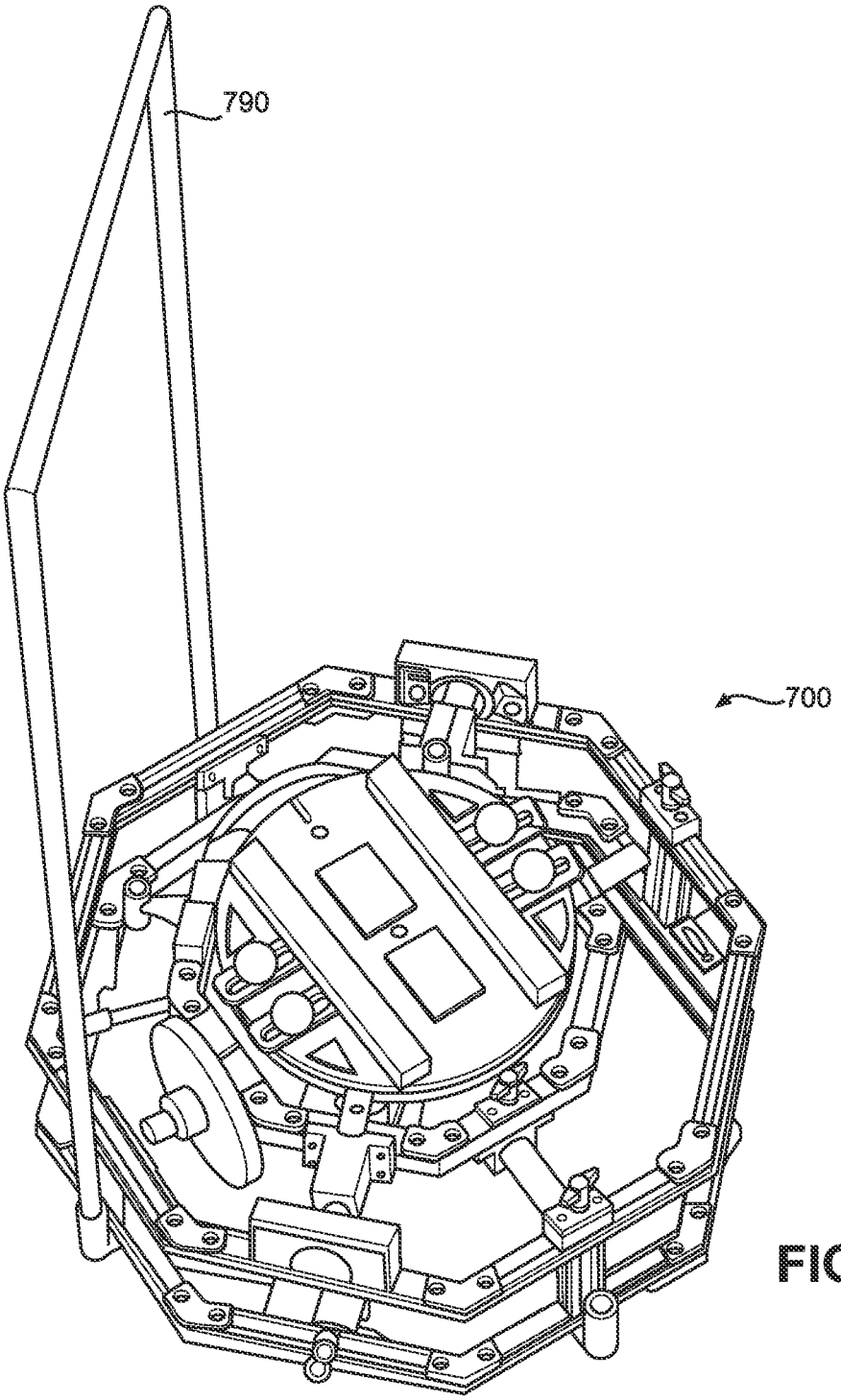

The exercise apparatus 600 can be used alone or in conjunction with another apparatus 600 for both feet together. It can be used in a sitting position (which can train the foot, ankle and knee) or in a standing position (which can train the hamstrings, IT band, adductors, hip and core). In some exemplary embodiments, as shown in FIGS. 15(*a*)-15(*c*), the exercise apparatus 600 can be used in conjunction with an angled base 660. The angled base 660 can have two stands at a rear portion 666, and no stands at a front portion 668, creating an angle downward from the rea portion 666 to the front portion 668. In some exemplary embodiments, the angle can be 20 degrees. The angled base 660 can have a top interior portion 662 surrounded by a frame 664 that provides a border around the top interior portion 662. The exercise apparatus 600 can be placed on the angled base 660 so that it fits securely within the top interior portion 662. That is, the angled base is sized so that the exercise apparatus 600 is snugly fit within the top interior portion 662 so that it doesn't slide within the top interior portion 662 when a user uses it.

As shown in FIG. 15(*c*), a user can place one foot within the exercise apparatus 600 in the angled base 660 to provide for various exercises. The user can place their other foot on a stool 680, which can be approximately a same height as the rear portion 666 of the angled base 660. Such an exercise allows a user to train a last phase of hip extension in gate which is internal hip rotation, which allows a unique training method for muscles of the hip. Placing a foot facing upward (as opposed to downward as shown in FIG. 15(*c*)), can allow a user to train the femoral head away from the acetabulum, which can help to create space between the bones allowing the user to improve hip mobility. A user can place their back against a wall which can allow the user a different angle to move the trochanter inside the hip joint allowing the user to improve hip strength and to increase circulation to the hip.

In some exemplary embodiments of the present disclosure, as shown in FIGS. 16-25, a portable foot exercise apparatus 700 can be provided which can provide a portable version for users or trainers, which allows for rotational and pivoting training with resistance tubing for constant resistance. Similar to the portable apparatus 600, the portable apparatus 700 can have a bottom plate 702 that sits on one or more stands 701, which are secured to an inner ring 750. The inner ring 750 can have any shape, such as but not limited to square, rectangular, circular or elliptical. In some exemplary embodiments, the inner ring 750 can be octagonal. The stands 701 can be transference bearings, which can enhance the responsiveness of the foot plate 708 when rotated when the base plate 706 and bottom plate 702 are rotated simultaneously. The inner ring 750 can be connected and secured to an upper base 760, which can be secured to a lower base 770. An angle indicator plate (not shown) can be provided on the inner ring 750.

A base plate 706 can be provided that is secured or welded to the bottom plate 702, and rotates along with bottom plate 702 with respect to the inner ring 750. A foot plate 708 is provided above the base plate 706, and a left support plate 710 and right support plate 712 can be provided on the foot plate 708 having a similar structure to the left support plate 118 and right support plate 120 above with respect to the exercise apparatus 100. The bottom plate 702, base plate 706 and foot plate 708 can have but are not limited to a circular shape. In some exemplary embodiments, the base plate 706 can have a smaller diameter than the bottom plate 702 and the foot plate 708.

For example, the portable apparatus 700 comprises a foot plate 708 which is provided on top of and secured to a base plate 706, such that the foot plate 708, base plate 706 and bottom plate 702 can rotate with respect to the inner ring 750. A left support plate 710 and a right support plate 712 are provided on top of the foot plate 708. The left support plate 710 and right support plate 712 have a vertically extending wall 714. The left support plate 710 and right support plate 712 can have one or more slots through which threaded knobs 718 secure the left support plate 710 and right support plate 712 to the foot plate 708. Two vertically extending walls 714 are provided on each of the left support plate 710 and right support plate 712, such that a user's foot can be placed between the vertically extending walls 714 of the left support plate 710 and right support plate 712. In some exemplary embodiments, padding 716 such as foam can be provided inward of the vertically extending walls 714 such that a user can place his foot between the padding 716 of the vertically extending walls 714 of the left support plate 710 and the right support plate 712. When a user turns his foot on the foot plate 708, the foot plate 708, left support plate 710 and right support plate 712, base plate 706 and bottom plate 702 all turn in the same direction with respect to the inner ring 750.

Similar as in the exercise apparatus 100, 500 and 600, a locking mechanism is provided between the foot plate 708 and base plate 706 such that a user can lift the foot plate 708 off of the base plate 706, and turn the foot plate 708 to a desired degree. Then, the user can release the foot plate 708, which would then lock the foot plate 708 to the base plate 706 at that location. In some exemplary embodiments, the foot plate 708 can be locked at 45 degree intervals in the clockwise and counterclockwise direction on the base plate 706. The bottom portion of the foot plate 708 can have a tapered pin 720 that corresponds to a hole 705 in the base plate 706 to secure the foot plate 708 to the base plate 706. In some exemplary embodiments, a strap (not shown) can be provided over the padding 716 and connected between the left support plate 710 and right support plate 712 to allow a user to pick up his foot and lift the foot plate 708 from the base plate 706.

In some exemplary embodiments, multiple holes (e.g, 4-40) 705 can be provided on the surface of the base plate 706 around the circumference of the base plate 706 at an equal distance from each other that correspond to a desired position of the tapered pin 720, such that a user can lift the foot plate 708 off the base plate 706 to release the tapered pin 720 from the base plate 706. Then, the user can rotate the foot plate 708 in either direction and place the tapered pin 720 into one of the holes 705 on the base plate 706, to lock and secure the foot plate 708 onto the base plate 706.

Resistance tubing can be provided on the portable apparatus 700 to provide resistance for training. In some exemplary embodiments, one or more threaded bolts 746 can be provided on the upper base 760 (or inner ring 750) on which a first end of a resistance element 748 can be provided. One or more metal brackets 740 can be secured to the bottom plate 706 for securing a hook of the resistance element 748. This provides resistance when using the portable exercise apparatus 700 for rotational training. As described above, more than one resistance element 748 can be provided on each threaded bolt 746 and connected to the holes 741 on the metal bracket 740. The foot plate 708 can be rotated in a clockwise or counterclockwise direction.

In some exemplary embodiments, a locking mechanism can be provided to prevent rotation of the foot plate 708. A plunger 752 can have a pin 756 that can be inserted through a block 754 that is secured to the inner ring 750. A plate 758 can be secured to the bottom plate 702. The plate 758 can have a hole that the pin 756 is inserted through that prevents rotation of the bottom plate 702, thereby restricting movement of the foot plate 708. When the plunger 752 is pulled and the pin 756 is removed from the hole on the plate 758, the bottom plate 702 is released and allows movement of the foot plate 708.

The portable apparatus 700 also allows for pivoting. The inner ring 750 is secured to a shaft 762 that is secured to the upper base 760. A plunger receiver 768 can have holes 767 and the plunger receiver 768 is secured (e.g., welded) to the inner ring 750 at a bottom portion thereof. One or more plunger mounts 766 are secured (e.g., welded) to the upper base 760, and can have holes to receive the plungers 764. The plungers 764 have pins 765 that are inserted into the holes 767 of the plunger receiver 768. This secures the inner ring 750 to the upper base 760 such that the inner base 760 can not pivot. When the plungers 764 are removed from the plunger receiver 768, the inner ring 750 (and the plate system, including the bottom plate 702, base plate 706 and foot plate 708) can pivot with respect to the upper base 760 (and lower base 770). The shaft 762 allows for the entire inner ring 750 to pivot with respect to the upper base 760, thus allowing for multiple exercises allowing pivoting of the foot. Resistance tubing can be provided to increase the difficulty of the pivoting exercises. For example, resistance tubing can be connected to the inner ring 750 at one end and the upper base 760 and/or lower base 760 at an opposite end.

In some exemplary embodiments, an angle plunger 772 can be provided that can allow for an angular adjustment of the inner ring 750 with respect to the upper base 760. The shaft 762 is secured through a pivoting shaft mount 780 that is secured to the inner ring 750. The shaft 762 also is secured through a mounting bearing 782 that can have a first angle slot 786 and a second angle slot 784. A mounting shaft is provided that is secured around the shaft 762 and to the mounting bearing 782. The plunger 772 can have a pin that connects to either the first angle slot 786 or the second angle slot 784. The first angle slot 786 can provide for an angle of, e.g., zero degrees, where the inner ring 750 is horizontal (e.g., parallel with the upper base 760). When the plunger 772 is connected to the second angle slot 784, the inner ring 750 can be provided at an angle with respect to the upper base 760. In some exemplary embodiments, the angle can be 4.5 degrees, or any angle can be provided. In some exemplary embodiments, multiple angle slots can be provided on the mounting bearing 782 that can fix the inner ring 750 at multiple angles with respect to the upper base 760. This can allow for, e.g., pivoting training at multiple angles. In some exemplary embodiments, a stand 790 can be secured to the exercise apparatus 700 (e.g., the upper base 760 or lower base 770) to allow a user to hold the stand 790 while going rotational and/or pivoting training.

Various other considerations can also be addressed in the exemplary applications described according to the exemplary embodiments of the present disclosure. For example, various materials may be used to construct the elements described in the figures. Various sizes and dimensions of the exercise apparatus and the parts thereof can be provided. Multiple variations of the pulleys 300 can be provided on the back pulley system 180 and on the exercise apparatus 100 to provide for various exercises and training. In some exemplary embodiments, as shown in FIG. 1, the exercise apparatus 100 can have a connected display 400 through a bracket that can be connected to the exercise apparatus 100 at a first end and the display 400 at a second end. A knob 404 can provide for vertical adjustment of the display 400 for various users. The display can provide exercise information and data on the user's workout. Sensors can be provided on the foot plate system 110, twist bar 160 and back pulley system 180 which can provide various data on the display 400. The sensors can measure resistance and strength in rotational range of motion for the user and trainer. Weighted foot plates 112 can provide data on the display as to how much weight the user is putting on each foot and which foot is taking more stress. Sensors on the twist bar 160 can advise the user how many degrees of trunk rotation they moved. Cameras can be provided to record the user's workout on the various devices of the exercise apparatus.

Various advantages can be provided based on the exemplary embodiments described above. For example, the exercise apparatus can allow a user to have an understanding on how to assess, test, analyze and strength train in rotation. A user can quickly achieve the desired strengthening or rehabilitation result they are looking for. The exercise apparatus incorporates the concepts of assessing posture and gait, and a trainer can assist a user in identifying muscle compensations that can occur in the body while training on the exercise apparatus. A trainer can teach specific stretches and muscle release techniques to reorganize fascia and reduce muscle tension. Breathing techniques can be incorporated to oxygenate the muscles and to enhance each training session. Following the muscle stretching and tissue release, a user can be taught to strength train on the exercise apparatus. Constant resistance provided can keep the brain engaged through the exercises, and key muscles can be strengthened around various body parts, such as the ankle, knee, hip and trunk.

The words "ranging", "ranges from", "ranges between" and other similar notations, are used herein interchangeably and are meant to include the first and second indicated numbers and all the fractional and integral numerals there between. It should be noted that where various embodiments are described by using a given range, the range is given as such merely for convenience and brevity and should not be construed as an inflexible limitation on the scope of the disclosure. Accordingly, the description of a range should be considered to have specifically disclosed all the possible sub-ranges as well as individual numerical values within that range.

The foregoing merely illustrates the principles of the disclosure. Various modifications and alterations to the described embodiments will be apparent to those skilled in the art in view of the teachings herein. It will thus be appreciated that those skilled in the art will be able to devise numerous systems, arrangements, manufacture and methods which, although not explicitly shown or described herein, embody the principles of the disclosure and are thus within the spirit and scope of the disclosure.

What is claimed is:

1. An exercise apparatus, comprising:

a base;

a bottom plate secured to a top portion of the base;

a bracket affixed to the bottom plate;

a base plate secured to a top portion of the bottom plate, the base plate including a plurality of holes on a top surface of the base plate;

a foot plate secured to a top portion of the base plate and configured to selectively engage with at least one of the plurality of holes on the top surface of the base plate, such that when the foot plate is rotated the base plate and bottom plate also rotate;

a threaded hole on the base; and a first resistance element having a first end secured to the threaded hole on the base and a second end secured to the bottom plate, such that resistance is provided from the first resistance element when the bottom plate, base plate and foot plate are rotated with respect to the base.

2. The exercise apparatus of claim 1, wherein the first resistance element comprises:

a first resistance tube;

a first hollow end portion secured to a first end of the first resistance tube; and a first hook secured to the first resistance tube at a second end of the first resistance tube opposite the first end;

wherein the first and second ends of the first resistance tube are respectively the first and second ends of the first resistance element.

3. The exercise apparatus of claim 2, further comprising:

a threaded bolt configured to be inserted within the first hollow end portion of the first resistance tube and the threaded hole on the base to secure the first resistance element to the base.

4. The exercise apparatus of claim 2, further comprising:

the bracket affixed to the bottom plate having one or more holes that the first hook of the first resistance tube is secured to.

5. The exercise apparatus of claim 4, further comprising:

a second resistance element having a first end secured to the threaded hole on the base and a second end secured to the bottom plate, such that resistance is provided from the first resistance element and the second resistance element when the bottom plate, base plate and foot plate are rotated with respect to the base.

6. The exercise apparatus of claim 5, wherein the second resistance element comprises:

a second resistance tube;

a second hollow end portion secured to a first end of the second resistance tube; and a second hook secured to the second resistance tube at a second end of the second resistance tube opposite the first end;

wherein the first and second ends of the second resistance tube are respectively the first and second ends of the second resistance element.

7. The exercise apparatus of claim 6, wherein a threaded bolt is configured to be inserted within the first hollow end portion of the first resistance tube and the second hollow end portion of the second resistance tube, and the threaded hole on the base to secure the first resistance element and the second resistance element to the base, and the second hook is secured to the one or more holes of the bracket affixed to the bottom plate.

8. The exercise apparatus of claim 1, further comprising:

a tapered pin on a bottom surface of the foot plate that can engage with one of the plurality of holes of the base plate.

9. The exercise apparatus of claim 8, wherein when the tapered pin is engaged to the one of the plurality of holes of the base plate, the foot plate and base plate are configured to rotate with respect to the base.

10. The exercise apparatus of claim 8, wherein the tapered pin is tapered at an angle of approximately three degrees to approximately five degrees.

11. The exercise apparatus of claim 1, further comprising:

a plate angle indicator provided on the base that provides an angle that the foot plate and base plate are rotated with respect to the base.

12. The exercise apparatus of claim 1, further comprising:

a first support plate provided on the foot plate and having a first wall extending upward from the foot plate; and a second support plate provided on the foot plate and having a second wall extending upward from the foot plate;

wherein a user's foot can be placed between the first wall and the second wall.

13. The exercise apparatus of claim 12, wherein the first support plate and the second support plate include slots.

14. The exercise apparatus of claim 13, further comprising:

one or more threaded knobs provided through the slots to secure the first support plate and second support plate to the foot plate.

15. The exercise apparatus of claim 12, further comprising:

padding secured to an inner portion of the first wall and the second wall.

16. The exercise apparatus of claim 1, wherein the foot plate is configured to disengage from the base plate when a foot of a user that is placed on the foot plate is lifted such that the user can then rotate the foot plate with respect to the base plate.

17. The exercise apparatus of claim 1, wherein the plurality of holes on the base plate comprise eight holes provided equidistant from each other on the top surface of the base plate.

18. The exercise apparatus of claim 1, wherein the base plate, foot plate and bottom plate can be rotated clockwise or counterclockwise with respect to the base.

19. An exercise apparatus, comprising:

a base having a circumferential frame;

a plate angle indicator secured within the circumferential frame of the base;

a bottom plate secured to a top portion of the base, the bottom plate having a diameter less than a diameter of the plate angular indicator;

a bracket affixed to the bottom plate and having one or more holes;

a base plate secured to a top portion of the bottom plate, the base plate including a plurality of holes on a top surface of the base plate;

a foot plate secured to a top portion of the base plate and configured to selectively engage with at least one of the plurality of holes on the top surface of the base plate, such that when the foot plate is rotated the base plate and bottom plate also rotate;

a threaded hole on the base; and a resistance element having a first end secured to the threaded hole on the base and a second end secured to one of the one or more holes on the bracket, such that resistance is provided from the resistance element when the foot plate is rotated with respect to the base.

20. The exercise apparatus of claim 19, wherein the resistance element comprises resistance tubing and the second end of the resistance element comprises a hook.

* * * * *